US009815643B2

(12) United States Patent
Tanisaki

(10) Patent No.: US 9,815,643 B2
(45) Date of Patent: Nov. 14, 2017

(54) PAPER FEEDING DEVICE, IMAGE FORMING APPARATUS, AND METHOD FOR CONTROLLING PAPER FEEDING DEVICE

(71) Applicant: KYOCERA Document Solutions Inc., Osaka (JP)

(72) Inventor: Yukio Tanisaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/926,855

(22) Filed: Oct. 29, 2015

(65) Prior Publication Data

US 2016/0121633 A1 May 5, 2016

(30) Foreign Application Priority Data

Oct. 31, 2014 (JP) ..... 2014-223365
Oct. 31, 2014 (JP) ..... 2014-223368

(51) Int. Cl.

| | |
|---|---|
| ***B65H 1/28*** | (2006.01) |
| ***B65H 1/08*** | (2006.01) |
| ***B65H 1/14*** | (2006.01) |
| ***B65H 3/44*** | (2006.01) |
| ***G03G 15/00*** | (2006.01) |

(52) U.S. Cl.

CPC ..... *B65H 1/28* (2013.01); *B65H 1/08* (2013.01); *B65H 1/14* (2013.01); *B65H 3/44* (2013.01); *G03G 15/6508* (2013.01); *G03G 15/6511* (2013.01); *G03G 15/6594* (2013.01); *B65H 2405/3311* (2013.01); *B65H 2511/414* (2013.01); *B65H 2553/412* (2013.01)

(58) Field of Classification Search

CPC ..... B65H 1/28; B65H 3/44; B54H 2405/331; B54H 2405/3311; B54H 2405/33
USPC ..... 271/9.02, 9.12, 9.13
See application file for complete search history.

(56) References Cited

U.S. PATENT DOCUMENTS 5,472,183 A * 12/1995 Kubo ..... B65H 1/08 271/110
5,988,622 A * 11/1999 Shigeta ..... G03G 15/6502 271/9.01

(Continued)

FOREIGN PATENT DOCUMENTS

JP 2002-37468 A 2/2002
JP 2009-263014 A 11/2009

(Continued)

OTHER PUBLICATIONS

Japanese Office Action dated Jul. 5, 2016, issued by the Japanese Patent Office in corresponding application JP 2014-223365.

*Primary Examiner* — Ernesto Suarez
(74) *Attorney, Agent, or Firm* — Stein IP, LLC

(57) ABSTRACT

A paper feeding device includes a first tray, a first elevation motor for moving up the first tray, a second tray for placing paper sheets, a second elevation motor for moving up the second tray, a separation plate disposed between the first tray and the second tray, an upper sensor unit and a lower sensor unit attached to the first tray, a light blocking plate attached to the second tray, and a controller. The paper feeding device has a tray parallel elevation mode in which both the trays are moved up in parallel in a state where the separation plate is removed.

8 Claims, 13 Drawing Sheets

(56) References Cited

U.S. PATENT DOCUMENTS

| | | | | |
|---|---|---|---|---|
| 6,123,329 | A * | 9/2000 | Sato | B65H 1/14 271/145 |
| 6,526,253 | B2 * | 2/2003 | Hayashi | G03G 15/6508 271/9.01 |
| 6,527,267 | B1 * | 3/2003 | Kuwata | B65H 3/44 271/9.13 |
| 6,603,952 | B2 * | 8/2003 | Hoene | B65H 1/14 271/157 |
| 7,497,434 | B2 * | 3/2009 | Park | B65H 1/14 271/126 |
| 8,360,416 | B2 * | 1/2013 | Hayama | B65H 1/14 271/147 |
| 8,439,343 | B2 * | 5/2013 | Yamaguchi | B65H 1/14 271/162 |
| 2015/0130124 | A1 * | 5/2015 | Muto | B65H 7/04 271/9.03 |
| 2017/0066611 | A1 * | 3/2017 | Nishihara | B65H 7/04 |
| 2017/0107066 | A1 * | 4/2017 | Masuda | B65H 1/08 |

FOREIGN PATENT DOCUMENTS

| | | | |
|---|---|---|---|
| JP | 2011-42494 | A | 3/2011 |
| JP | 2011-136804 | A | 7/2011 |

* cited by examiner

| UPPER SENSOR | LOWER SENSOR | LEFT TRAY | RIGHT TRAY |
|---|---|---|---|
| LIGHT BLOCKING OUTPUT VALUE | LIGHT BLOCKING OUTPUT VALUE | — | — |

| UPPER SENSOR | LOWER SENSOR | LEFT TRAY | RIGHT TRAY |
|---|---|---|---|
| LIGHT BLOCKING OUTPUT VALUE | LIGHT BLOCKING OUTPUT VALUE | ELEVATION | ELEVATION |

| UPPER SENSOR | LOWER SENSOR | LEFT TRAY | RIGHT TRAY |
|---|---|---|---|
| LIGHT BLOCKING OUTPUT VALUE | TRANSPARENT OUTPUT VALUE | ELEVATION | STOP |

| UPPER SENSOR | LOWER SENSOR | LEFT TRAY | RIGHT TRAY |
|---|---|---|---|
| TRANSPARENT OUTPUT VALUE | LIGHT BLOCKING OUTPUT VALUE | STOP | ELEVATION |

PAPER FEEDING DEVICE, IMAGE FORMING APPARATUS, AND METHOD FOR CONTROLLING PAPER FEEDING DEVICE

INCORPORATION BY REFERENCE

This application is based upon and claims the benefit of priority from the corresponding Japanese Patent Applications No. 2014-223365 and No. 2014-223368 filed Oct. 31, 2014, the entire contents of which are incorporated herein by reference.

BACKGROUND

The present disclosure relates to a paper feeding device and an image forming apparatus including the paper feeding device.

An image forming apparatus is provided with a paper feeding device for storing and feeding paper sheets to be used for printing. The paper feeding device is usually a type in which only one size of paper sheets can be set. However, when the paper feeding device that supports A3 size is used for setting A4 or B5 paper sheets, for example, there is a large vacant space. Accordingly, there is a case where a single paper feeding device is capable of setting sets of paper sheets in parallel so that more paper sheets can be stored.

There is known a sheet feeding device in which two sets of paper sheets can be set. Specifically, there is known a sheet feeding device capable of performing tandem feed operation, in which a first sheet loading table is movable up and down, a sheet is fed from the first sheet loading table, a second sheet loading table capable of moving up and down is disposed side by side with the first sheet loading table substantially in a horizontal direction, a set of sheets on the second sheet loading table is moved onto the first sheet loading table, when the set of sheets is moved, stop positions of the first sheet loading table and the second sheet loading table stopping at substantially the same height are detected, and when sheets on the first sheet loading table run out, the set of sheets on the second sheet loading table is automatically moved onto the first sheet loading table so that sheet feeding operation is continued.

In the known sheet feeding device described above, a spare set of sheets is moved onto the sheet loading table that has run out of sheets. In contrast, there is a paper feeding device in which a plurality of trays are disposed in a single-stage paper feeding device, and each tray can feed paper sheets (hereinafter, this paper feeding device is referred to as a "multi-tray housing paper feeding device"). In other words, in the multi-tray housing paper feeding device, one (stage) paper feeding device is divided into a plurality of rooms, and paper sheets can be fed from each room.

In the multi-tray housing paper feeding device, a plurality of (e.g., two) sets of relatively small size paper sheets can be set side by side. In the multi-tray housing paper feeding device, a paper feed roller and a tray elevation mechanism are disposed for each tray. Further, each tray is moved up so that each paper feed roller contacts with the paper sheet on each tray in accordance with remaining paper sheets on each tray.

The multi-tray housing paper feeding device has a merit that the space in the paper feeding device can be effectively used so that the number of paper sheets to be stored can be increased. On the other hand, in the multi-tray housing paper feeding device, a size of one paper sheet tray becomes small, and a large size of paper sheet (for example, a tabloid size or an A3 size) cannot be set. Conventionally, the multi-tray housing paper feeding device has a problem that large size paper sheets cannot be structurally set, and hence the usability is not good.

Here, the known paper feeding device described above can house two sets of sheets in a single stage of space. However, it is not expected to set large size paper sheets larger than the tray in the paper feeding device, and hence the above-mentioned problem cannot be solved.

SUMMARY

In order to solve the above-mentioned problem, a paper feeding device according to an aspect of the present disclosure includes a first paper feeding portion, a second paper feeding portion, a separation plate, a sensor unit, and a controller, and the paper feeding device has a tray parallel elevation mode. The first paper feeding portion includes a first tray on which paper sheets are placed, a first paper feed roller for sending out the paper sheets placed on the first tray, and a first elevation mechanism for allowing the first tray to move up by a power from a first elevation motor so that the paper sheet placed on the first tray contacts with the first paper feed roller. The second paper feeding portion includes a second tray on which paper sheets are placed, a second paper feed roller for sending out the paper sheets placed on the second tray, and a second elevation mechanism for allowing the second tray to move up by a power from a second elevation motor so that the paper sheet on the second tray contacts with the second paper feed roller, and is disposed side by side with the first paper feeding portion in a horizontal direction. The separation plate is disposed to stand between the first tray and the second tray. The sensor unit is a sensor attached to the first tray so as to sense a position of the second tray. The controller receives an output of the sensor unit and controls ON/OFF of the first elevation motor and the second elevation motor. The tray parallel elevation mode is a mode in which the separation plate is removed, paper sheets having a larger size than each of sheet placing surfaces of the first tray and the second tray are placed to stride over both the first tray and the second tray, and the both trays are moved up.

Further features and advantages of the present disclosure will become apparent from the description of embodiments given below.

DETAILED DESCRIPTION

The present disclosure relates to a multi-tray housing paper feeding device configured to allow a plurality of trays to move up without a collapse of a stack of large size paper sheets placed to stride over the trays without using expensive motors and circuits in a multi-tray housing paper feeding device. Hereinafter, an embodiment of the present disclosure is described with reference to FIGS. 1 to 22. Here, in this description, a multifunction peripheral 100 (corresponding to an image forming apparatus) including a paper feeding device 1 according to the present disclosure is exemplified. However, elements such as structures and layouts described in this embodiment are merely examples for description and should not be interpreted to restrict the scope of the description.

(Outline of Multifunction Peripheral 100)

Figure 1:
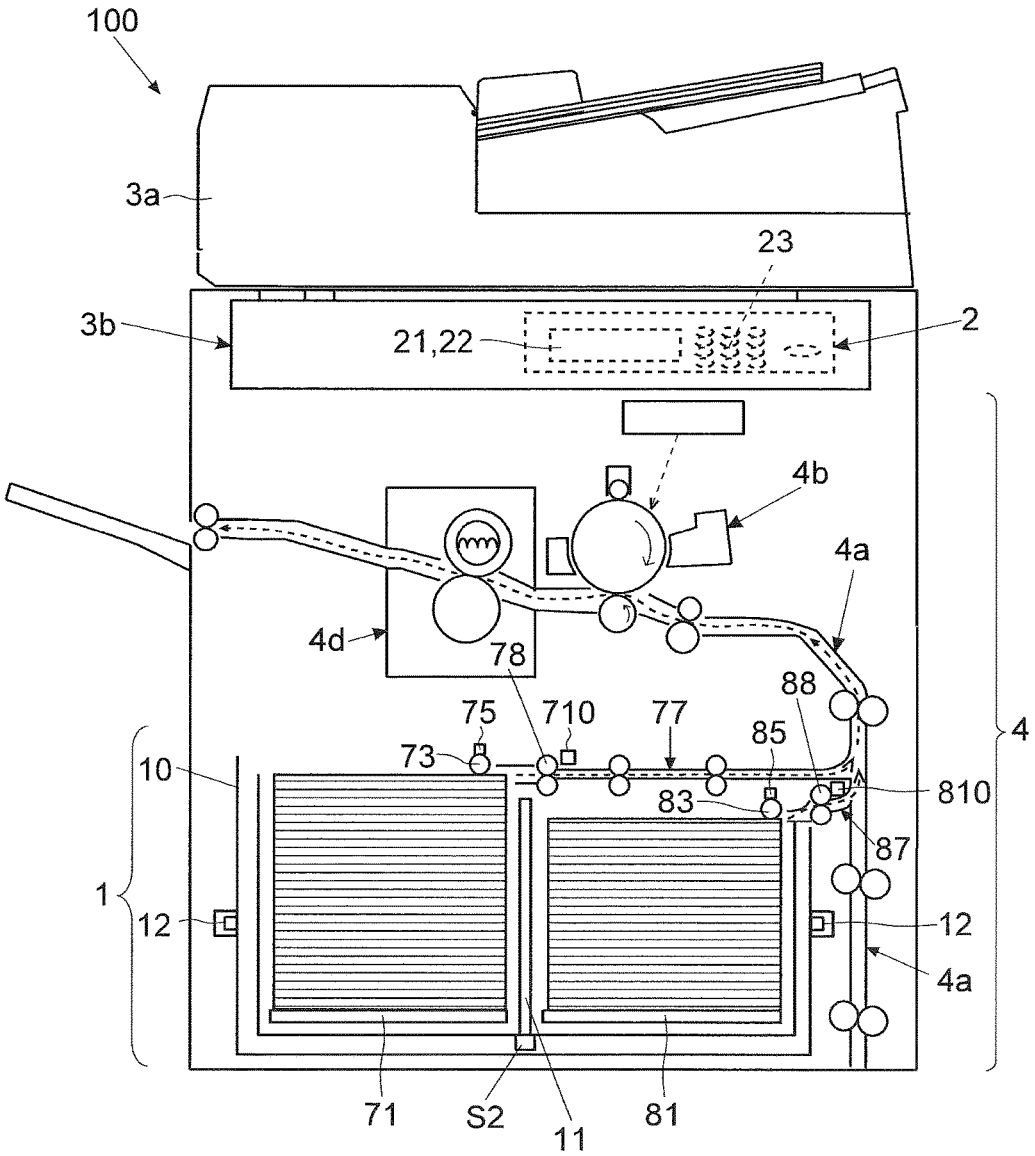
FIG. 1 is a diagram showing an example of a multifunction peripheral.

First, with reference to FIG. 1, an outline of the multifunction peripheral 100 according to the embodiment is described.

As shown in FIG. 1, the multifunction peripheral 100 of this embodiment includes an operation panel 2 attached to the front. The operation panel 2 includes a display unit 21 for displaying information related to the multifunction peripheral 100 and information related to jobs. In addition, the operation panel 2 includes hardware keys 23 and a touch panel 22 as an input unit for receiving user's setting.

A document feeder 3*a* and an image reader 3*b* are disposed on an upper part of the multifunction peripheral 100. The document feeder 3*a* feeds set document sheets to pass a reading position. The image reader 3*b* reads the fed document sheet or a document placed on a contact glass so as to generate image data.

In addition, the multifunction peripheral 100 includes a printer unit 4 inside. The printer unit 4 includes the paper feeding device 1, a conveying portion 4*a*, an image forming portion 4*b*, a fixing portion 4*c*, and the like. The paper feeding device 1 stores a plurality of paper sheets and sends out the paper sheet for printing (details will be described later). The conveying portion 4*a* conveys the paper sheet supplied from the paper feeding device 1 to the image forming portion 4*b* and conveys the paper sheet after passing through the fixing portion 4*c* so as to discharge the paper sheet to the outside of the apparatus. The image forming portion 4*b* forms a toner image based on image data to be printed and transfers the toner image onto the paper sheet. The fixing portion 4*c* heats and presses the paper sheet with the transferred toner image so that the toner image is fixed to the paper sheet.

(Hardware Structure of Multifunction Peripheral 100)

Figure 2:
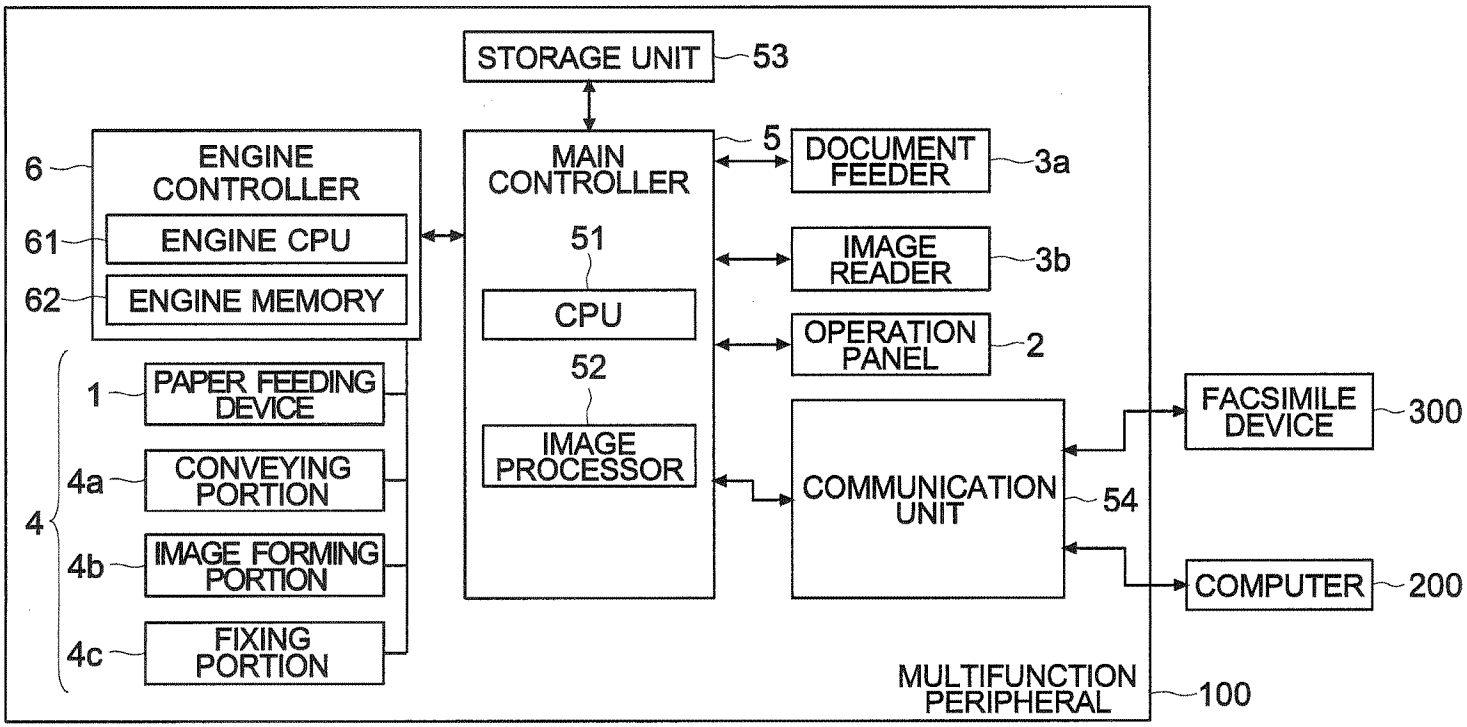
FIG. 2 is a diagram showing an example of a hardware structure of the multifunction peripheral.

Next, with reference to FIG. 2, a hardware structure of the multifunction peripheral 100 according to the embodiment is described.

As shown in FIG. 2, the multifunction peripheral 100 includes a main controller 5. The main controller 5 controls individual portions included in the multifunction peripheral 100. The main controller 5 includes a CPU 51, an image processor 52 configured to perform image processing on the image data to be used for printing or transmission, and other electronic circuits and elements. The CPU 51 performs controls and calculations for individual portions of the multifunction peripheral 100 on the basis of a control program and control data stored in a storage unit 53. The storage unit 53 is a combination of nonvolatile storage devices such as a ROM, a flash ROM, and an HDD, and a volatile storage device such as a RAM.

The main controller 5 issues operation instructions to an engine controller 6 (corresponding to the controller) for controlling (for print-controlling) the printer unit 4 (the paper feeding device 1, the conveying portion 4*a*, the image forming portion 4*b*, the fixing portion 4*c*, and the like), the document feeder 3*a*, and the image reader 3*b*. When receiving the instruction from the main controller 5, the engine controller 6 controls the paper feeding device 1 to feed the paper sheet and controls the printer unit 4 to perform printing. The main controller 5 instructs the engine controller 6 to perform printing based on print data received from a computer 200 or the image data obtained by document reading with the document feeder 3*a* and the image reader 3*b* (a copy function or a printer function).

The engine controller 6 includes an engine CPU 61 and an engine memory 62 storing data and a program for controlling the printer unit 4. The engine CPU 61 controls operation of the printer unit 4 on the basis of an instruction from the main controller 5 and the data and the program in the engine memory 62. In addition, the engine controller 6 receives outputs of various sensors disposed in the printer unit 4 so as to recognize a state of the printer unit 4. Further, the engine controller 6 includes a motor control circuit 63 for controlling ON/OFF and rotation speeds of various motors (see FIG. 3).

In addition, the main controller 5 is connected to a communication unit 54. The main controller 5 controls an operation and a communication process of the communication unit 54. The communication unit 54 is an interface for communication with the computer 200 such as a personal computer or a server and with a facsimile device 300. In addition, the main controller 5 controls an operation of the operation panel 2 such as notification. The main controller 5 recognizes contents of operations and settings made with the operation panel 2 and recognizes set contents and a print execution instruction.

(Outline of Paper Feeding Device 1)

Figure 3:
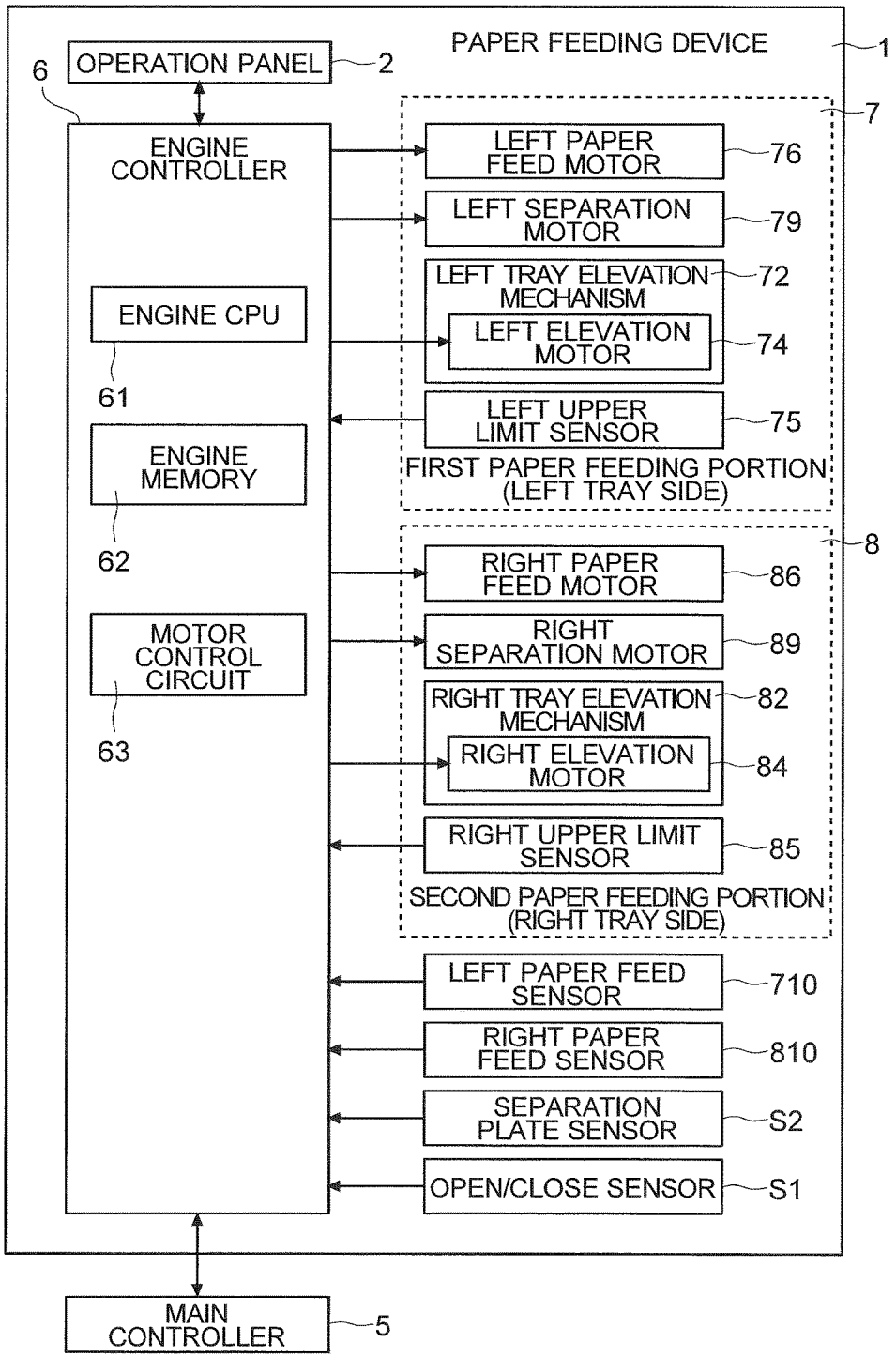
FIG. 3 is a diagram showing an example of a paper feeding device.

Next, with reference to FIGS. 1 and 3, an outline of the paper feeding device 1 according to the embodiment is described. FIG. 3 is a diagram showing an example of the paper feeding device 1.

The paper feeding device 1 according to the embodiment includes a left tray 71 (corresponding to the first tray) on which paper sheets are placed and a right tray 81 (corresponding to the second tray) on which paper sheets are placed, which are disposed in a housing 10. The housing 10 has a box shape with an upper surface opened. As shown in FIG. 1, slide units 12 are disposed respectively on the right and left outside the housing 10. Using the slide units 12, the housing 10 (paper feeding device 1) and members attached to the paper feeding device 1 can be horizontally drawn out frontward from the multifunction peripheral 100.

The user draws out the housing 10 and replenishes paper sheets from above. One tray can store approximately 500 to 1000 paper sheets. After paper sheets are replenished, the housing 10 is pushed back. Then, the housing 10 is retracted in a main body of the multifunction peripheral 100, and the paper feeding device 1 is closed. The paper feeding device 1 is equipped with an open/close sensor S1 for detecting an open or closed state of the housing 10 (whether or not the housing 10 is drawn out). The engine controller 6 recognizes whether the housing 10 is drawn out or closed and housed in the main body on the basis of an output of the open/close sensor S1.

The left tray 71 and the right tray 81 have the same size. As a single unit, each tray can store paper sheets of a size up to an A4 size or a letter size. A left tray elevation mechanism 72 (corresponding to the first elevation mechanism) allows the left tray 71 (the first tray) to move up and down. In addition, the left tray elevation mechanism 72 allows the first tray to move up by power from the first elevation motor (a left elevation motor 74) so that the placed paper sheet contacts with a left paper feed roller 73 (corresponding to a first paper feed roller). A right tray elevation mechanism 82 (corresponding to the second elevation mechanism) allows the right tray 81 to move up and down. In addition, the right tray elevation mechanism 82 allows the second tray to move up by power from the second elevation motor (a right elevation motor 84) so that the paper sheet placed on the right tray 81 (second tray) contacts with a right paper feed roller 83 (corresponding to a second paper feed roller). The left tray 71 and the right tray 81 are disposed side by side in the horizontal direction that is the right and left direction of the multifunction peripheral 100.

The left paper feed roller 73 (corresponding to the first paper feed roller) is provided to the left tray 71. The left paper feed roller 73 sends out the paper sheet placed on the left tray 71. The engine controller 6 controls the left elevation motor 74 (corresponding to the first elevation motor) to rotate in the left tray elevation mechanism 72. The engine controller 6 recognizes that the left tray 71 is moved up to an upper limit position (paper feed position) on the basis of an output of a left upper limit sensor 75 (corresponding to the first upper limit sensor). Specifically, the engine controller 6 controls the left tray 71 to move up until the top paper sheet contacts with the left paper feed roller 73. In this way, the engine controller 6 controls ON/OFF of the left elevation motor 74. Further, when feeding the paper sheet from the left tray 71, the engine controller 6 controls a left paper feed motor 76 to rotate (see FIG. 3). In this way, the left paper feed roller 73 rotates. A left paper feed path 77 is disposed at a position to which the paper sheet is fed from the left paper feed roller 73. The left paper feed path 77 conveys the paper sheet by a drive power of the left paper feed motor 76 or other motor.

The left paper feed path 77 guides the paper sheet fed from the left tray 71 to join the conveying portion 4*a*. A left separation roller pair 78 is disposed at an upper stream part of the left paper feed path 77. The left separation roller pair 78 is driven by a left separation motor 79 to rotate. An upper roller of the left separation roller pair 78 rotates to convey the paper sheet in a forward direction, and a lower roller thereof rotates to convey the same in a backward direction. When double feeding occurs, the left separation roller pair 78 coveys the lower paper sheet back to the left tray 71. In addition, in the left paper feed path 77, there is disposed a left paper feed sensor 710 for detecting whether or not the paper sheet is appropriately fed.

The right paper feed roller 83 is provided to the right tray 81. The right paper feed roller 83 sends out the paper sheet placed on the second tray. The engine controller 6 controls the right elevation motor 84 (corresponding to the second elevation motor) to rotate in the right tray elevation mechanism 82. The engine controller 6 recognizes that the right tray 81 is moved up to an upper limit position (paper feed position) on the basis of an output of a right upper limit sensor 85 (corresponding to the second upper limit sensor). The engine controller 6 controls the right tray 81 to move up until the top paper sheet contacts with the right paper feed roller 83. In this way, the engine controller 6 controls ON/OFF of the right elevation motor 84. Further, when feeding the paper sheet from the right tray 81, the engine controller 6 controls a right paper feed motor 86 to rotate (see FIG. 3). In this way, the right paper feed roller 83 rotates. A right paper feed path 87 is disposed at a position to which the paper sheet is fed from the right paper feed roller 83. The right paper feed path 87 conveys the paper sheet by a drive power of the right paper feed motor 86 or other motor.

The right paper feed path 87 guides the paper sheet fed from the right tray 81 to join the conveying portion 4*a*. A right separation roller pair 88 is disposed at an upper stream part of the right paper feed path 87. The right separation roller pair 88 is driven by a right separation motor 89 to rotate. An upper roller of the right separation roller pair 88 rotates to convey the paper sheet in a forward direction, and a lower roller thereof rotates to convey the same in a backward direction. When double feeding occurs, the right separation roller pair 88 coveys the lower paper sheet back to the right tray 81. In addition, in the right paper feed path 87, there is disposed a right paper feed sensor 810 for detecting whether or not the paper sheet is appropriately fed.

The left paper feed motor 76, the left separation motor 79, the left tray elevation mechanism 72, the left upper limit sensor 75, and the like constitute a first paper feeding portion 7. The first paper feeding portion 7 is a portion for feeding paper sheets stored in the left side of the paper feeding device 1. In addition, the right paper feed motor 86, the right separation motor 89, the right tray elevation mechanism 82, the right upper limit sensor 85, and the like constitute a second paper feeding portion 8. The second paper feeding portion 8 is a portion for feeding paper sheets stored in the right side of the paper feeding device 1. Further, the first paper feeding portion 7 and the second paper feeding portion 8 are disposed side by side in the right and left direction of the multifunction peripheral 100 (in the horizontal direction).

As shown in FIG. 1, a separation plate 11 is disposed between the first paper feeding portion 7 and the second paper feeding portion 8. The separation plate 11 is a plate disposed to stand vertically between the first paper feeding portion 7 and the second paper feeding portion 8, so as to separate the first paper feeding portion 7 from the second paper feeding portion 8 along the front and rear direction of the multifunction peripheral 100. This separation plate 11 prevents the paper sheets in one of the left tray 71 and the right tray 81 from avalanching into the other tray.

The separation plate 11 is removable. In order to detect whether the separation plate 11 is attached or removed, a separation plate sensor S2 is disposed below the middle of the paper feeding device 1 where the separation plate 11 is disposed. The engine controller 6 can recognize or detect whether the separation plate 11 is attached or removed on the basis of an output of the separation plate sensor S2. It is possible to adopt a structure in which the engine controller 6 or the main controller 5 detects presence or absence of the separation plate 11 when the operation panel 2 receives an input indicating whether or not the separation plate 11 is attached.

(Elevation Mechanism)

Figure 4:
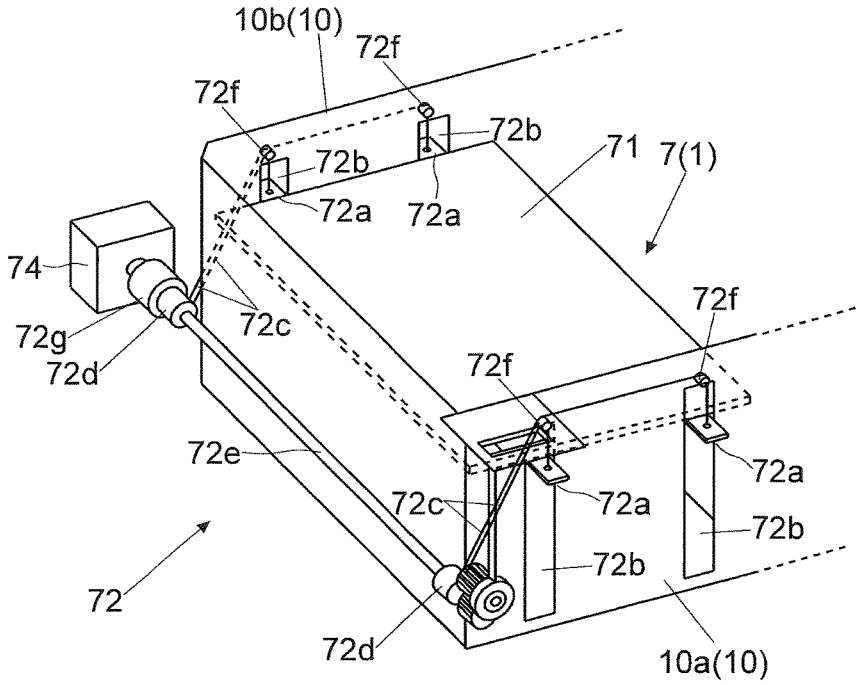
FIG. 4 is a diagram showing an example of a left tray elevation mechanism.
Figure 5:
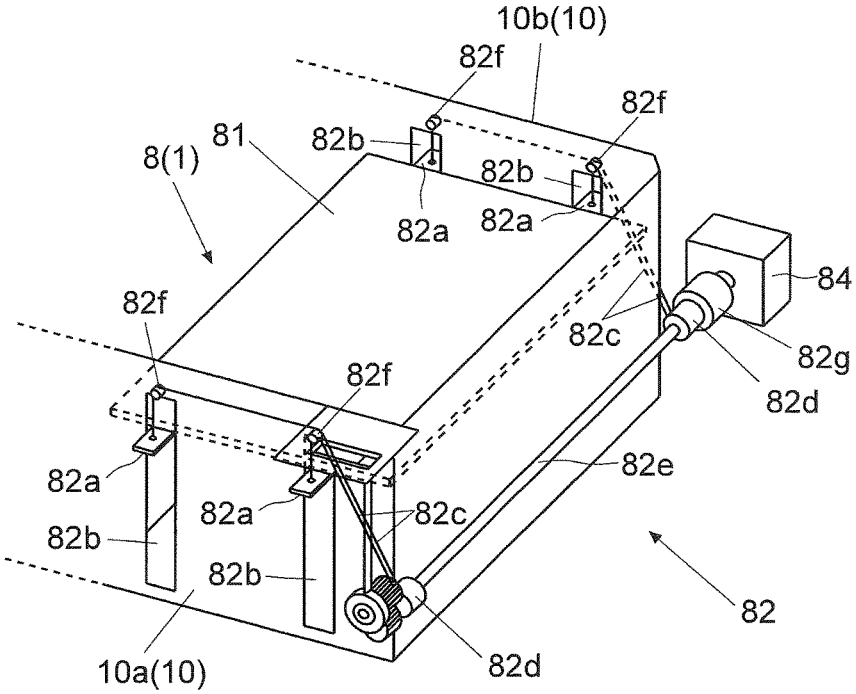
FIG. 5 is a diagram showing an example of a right tray elevation mechanism.

Next, with reference to FIGS. 3 to 5, the elevation mechanisms of the left tray 71 and the right tray 81 are described.

First, the left tray elevation mechanism 72 is described. As shown in FIG. 4, protrusions 72*a* are disposed on each of a front side and a rear side of the left tray 71. The protrusions 72*a* protrude in the horizontal direction and are disposed at two positions side by side in a lateral direction (the right and left direction) on each side (at total four positions). Further, openings 72*b* are respectively formed in a front wall 10*a* and a rear wall 10*b* of the housing 10 at positions corresponding to the protrusions 72*a*. The opening 72*b* is elongated in the vertical direction. Each protrusion 72*a* protrudes from the opening 72*b* to the outside of the housing 10.

As shown in FIG. 4, the left tray elevation mechanism 72 is disposed on the left side surface of the housing 10. The left tray elevation mechanism 72 includes wires 72*c*, reels 72*d*, a rotation shaft 72*e*, pulleys 72*f*, and a joint part 72*g*. Two of the wires 72*c* are disposed on each of a front outside and a rear outside of the housing 10. The two reels 72*d* are respectively disposed on the front side and the rear side of the housing 10. An end of each wire 72*c* is connected to the reel 72*d*, and the other end of the same is connected to an upper surface of the corresponding protrusion 72*a*. Each wire 72*c* is wound around a pulley 72*f* disposed at an outside upper part of the housing 10 between the reel 72*d* and the protrusion 72*a*.

The rotation shaft 72*e* extending in the front and rear direction is disposed at a lower left part of the housing 10. The rotation shaft 72*e* is connected to the left elevation motor 74 via the joint part 72*g*. The engine controller 6 controls the left elevation motor 74 to rotate the rotation shaft 72*e* and the reel 72*d* so that the left tray 71 is raised. Specifically, the left tray 71 is moved up when the reel 72*d* winds the wire 72*c*, while the left tray 71 is moved down when the wire 72*c* is unreeled.

When the housing 10 is drawn out to the front, a linkage between the left elevation motor 74 and the rotation shaft 72*e* is released by action of the joint part 72*g*. When the linkage is released, the left tray 71 is automatically moved down by gravity. In other words, when a predetermined condition is satisfied by drawing out the housing 10 (the left tray 71) frontward, the left tray elevation mechanism 72 allows the left tray 71 to be moved down by gravity. Finally, the left tray 71 is moved down to a lower limit position (reference position). Note that the left tray 71 and the right tray 81 have the same lower limit position. For this reason, when the housing 10 is drawn out, the left tray 71 and the right tray 81 become the same height. In addition, when a main power is shut off or when transiting to a power save mode so that power supply to the paper feeding device 1 is stopped, because the power to move up the left tray 71 is lost, the left tray 71 is moved down to the lower limit position.

In addition, when the housing 10 is closed, the left elevation motor 74 is linked to the rotation shaft 72*e* by action of the joint part 72*g*. When the engine controller 6 recognizes that the housing 10 is closed on the basis of the output of the open/close sensor S1, and when power supply is started by turning on the main power or by canceling the power save mode, the engine controller 6 controls the left elevation motor 74 to move the left tray 71 up to a position at which paper feed can be performed.

The left paper feed roller 73 swings up and down. When the left paper feed roller 73 is raised by a predetermined distance or more as the left tray 71 is raised, the left upper limit sensor 75 (switch) provided to the left paper feed roller 73 is turned on (or off). On the basis of an output change of the left upper limit sensor 75, the engine controller 6 knows that the left tray 71 has reached the paper feed position (upper limit position). Then, the engine controller 6 controls the left elevation motor 74 to stop.

Next, the right tray elevation mechanism 82 is described. Basically, the right tray elevation mechanism 82 has the same structure as the left tray elevation mechanism 72. As shown in FIG. 5, protrusions 82*a* protruding in the horizontal direction are disposed on each of a front side and a rear side of the right tray 81. The protrusions 82*a* are disposed at two positions side by side in a lateral direction (the right and left direction) on each side (at total four positions). Further, openings 82*b* are respectively formed in the front wall 10*a* and the rear wall 10*b* of the housing 10 at positions corresponding to the protrusions 82*a*. The opening 82*b* is elongated in the vertical direction. Each protrusion 82*a* protrudes from the opening 82*b* to the outside of the housing 10.

As shown in FIG. 5, the right tray elevation mechanism 82 for the right tray 81 is disposed on the right side surface of the housing 10. The right tray elevation mechanism 82 includes wires 82*c*, reels 82*d*, a rotation shaft 82*e*, pulleys 82*f*, a joint part 82*g*, and the like. Two of the wires 82*c* are disposed on each of the front outside and the rear outside of the housing 10. The two reels 82*d* are respectively disposed on the front side and the rear side of the housing 10. An end of each wire 82*c* is connected to the reel 82*d*, and the other end of the same is connected to an upper surface of one of the protrusions 82*a*. Each wire 82*c* is wound around a pulley 82*f* disposed at the outside upper part of the housing 10 between the reel 82*d* and the protrusion 82*a*.

The rotation shaft 82*e* extending in the front and rear direction is disposed at a lower right part of the housing 10. The rotation shaft 82*e* is connected to the right elevation motor 84 via the joint part 82*g*. The engine controller 6 controls the right elevation motor 84 to rotate the rotation shaft 82*e* and the reel 82*d* so that the right tray 81 is moved up. Specifically, the right tray 81 is moved up when the reel 82*d* winds the wire 82*c*, while the right tray 81 is moved down when the wire 82*c* is unreeled.

When the housing 10 is drawn out to the front, a linkage between the right elevation motor 84 and the rotation shaft 82*e* is released by action of the joint part 82*g*. When the linkage is released, the right tray 81 is automatically moved down by gravity. In other words, when a predetermined condition is satisfied by drawing out the housing 10 frontward so that the right tray 81 is drawn out, the right tray elevation mechanism 82 allows the right tray 81 to be moved down by gravity. Finally, the right tray 81 is moved down to a lower limit position (reference position). In addition, when a main power is shut off or when transiting to a power save mode so that power supply to the paper feeding device 1 is stopped, because the power to move up the right tray 81 is lost, the right tray 81 is moved down to the lower limit position.

In addition, when the housing 10 is closed, the right elevation motor 84 is linked to the rotation shaft 82*e* by action of the joint part 82*g*. When the engine controller 6 recognizes that the housing 10 is closed on the basis of the output of the open/close sensor 51, and when power supply is started by turning on the main power or by canceling the power save mode, the engine controller 6 controls the right elevation motor 84 to move the right tray 81 up to a position at which paper feed can be performed.

The right paper feed roller 83 swings up and down. When the right paper feed roller 83 is raised by a predetermined distance or more as the right tray 81 is raised, the right upper limit sensor 85 (switch) provided to the right paper feed roller 83 is turned on (or off). On the basis of an output change of the right upper limit sensor 85, the engine controller 6 knows that the right tray 81 has reached the paper feed position (upper limit position). Then, the engine controller 6 controls the right elevation motor 84 to stop.

(Tray Parallel Elevation Mode)

Figure 6:
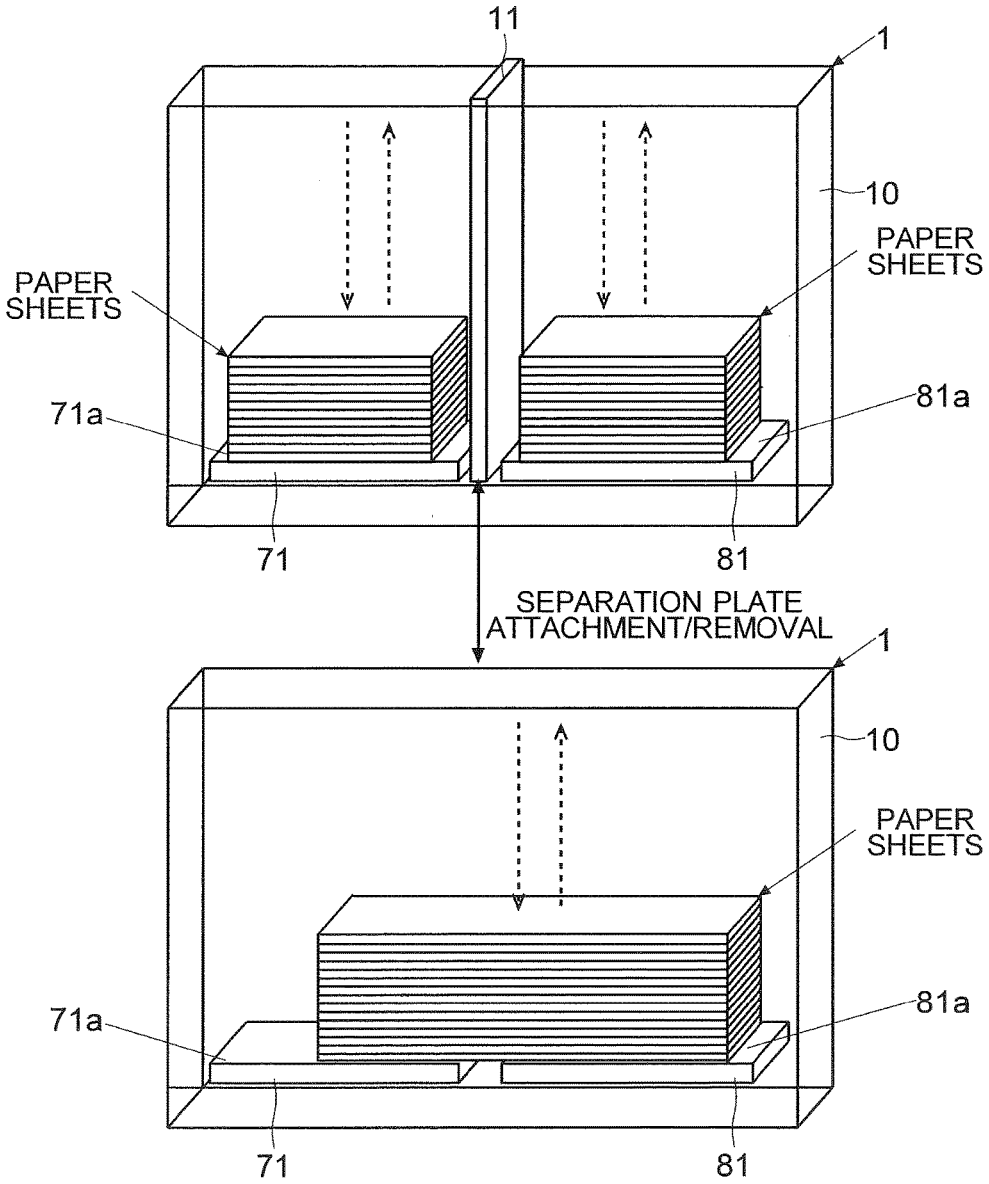
FIG. 6 is a diagram for explaining a tray parallel elevation mode.

Next, with reference to FIG. 6, an outline of a tray parallel elevation mode of the paper feeding device 1 according to the embodiment is described.

The paper feeding device 1 according to the embodiment includes a plurality of trays in the casing (housing 10). As shown in the upper side of FIG. 6, the left tray 71 and the right tray 81 are independent from each other to move up to the paper feed position. Specifically, the engine controller 6 controls the left tray 71 to move up to the paper feed position (upper limit position) in accordance with a thickness of the paper sheets on the left tray 71 and controls the right tray 81 to move up to the paper feed position (upper limit position) in accordance with a thickness of the paper sheets on the right tray 81. In this way, the space in the paper feeding device 1 is effectively used so that the number of paper sheets to be stored in the paper feeding device 1 can be increased compared with the paper feeding device 1 in which only one size of paper sheets can be stored in the paper feeding device 1. In addition, it is possible to set a different size of paper sheets can be set in one tray.

However, when a plurality of trays are disposed in the paper feeding device 1, a size of one tray becomes small. The paper feeding device housing one tray usually supports an A3 size or a tabloid size as a maximum size of stored paper sheets. However, when two trays are disposed in the paper feeding device, the maximum size of stored paper sheets becomes ½ of the A3 size (the letter size or the A4 size). Accordingly, when a plurality of trays are disposed in the paper feeding device 1, paper feed of a large size paper sheet cannot be usually performed.

Accordingly, the separation plate 11 can be removed in the paper feeding device 1 of this embodiment. Further, as shown in the lower side of FIG. 6, in the state where the separation plate 11 is removed, paper sheets of a larger size than the placing surface 71*a* of the left tray 71 or the placing surface 81*a* of the right tray 81 (e.g., the tabloid size or the A3 size paper sheets) are placed to stride over the left tray 71 and the right tray 81, and the both trays can be raised together without collapsing a stack of the paper sheets. Note that the mode of raising the both trays in parallel is referred to as the "tray parallel elevation mode".

(Structure for Raising Trays in Parallel)

Next, with reference to FIGS. 7 to 10, a structure for raising the both trays in parallel is described.

In the case where the both trays are raised in the state where the paper sheets are placed to stride over both trays (the left tray 71 and the right tray 81), when there is a difference of rising speed between the left tray 71 and the right tray 81, a height difference d between the left tray 71 and the right tray 81 (see FIG. 12) becomes large, and hence the stack of paper sheets may be collapsed. In the state where the stack of paper sheets is collapsed, paper feed cannot be appropriately performed. In addition, even if the paper sheets reach the paper feed position without being collapsed, when the height difference d between the left tray 71 and the right tray 81 is large, paper feed may not be appropriately performed because of the inclination of the paper sheet.

For this reason, in the tray parallel elevation mode of the paper feeding device 1, when the trays are moved up in the state where the paper sheets are placed to stride over the left tray 71 and the right tray 81, the height difference d between the left tray 71 and the right tray 81 is maintained within a permissible range. In this way, in any number of the paper sheets, it is possible to prevent the stack of paper sheets from collapsing and to prevent an occurrence of a problem in the paper feed.

Here, DC motors (brush motors) are used as the left elevation motor 74 and the right elevation motor 84 of the paper feeding device 1. A brush motor has an advantage that it is easy to obtain a torque for raising the tray with many paper sheets stacked and an advantage of being low cost.

However, the brush motor also has an individual variation of rotation speed when a constant voltage (current) is supplied, and the rotation speed varies depending on a load. Accordingly, it is more difficult to rotate the two brush motors as the left elevation motor 74 and the right elevation motor 84 at the same speed so as to raise the left tray 71 and the right tray 81 at the same speed than in the case where stepping motors are used. When using the stepping motors, it is relatively easy to tune pulse frequencies of them to be the same so that rotation speeds of the plurality of motors becomes the same. However, the stepping motor itself is more expensive than the brush motor. In addition, a circuit and a substrate for driving the stepping motors are necessary. Accordingly, use of stepping motors may cause the cost of the paper feeding device 1 to increase largely.

Figure 7:
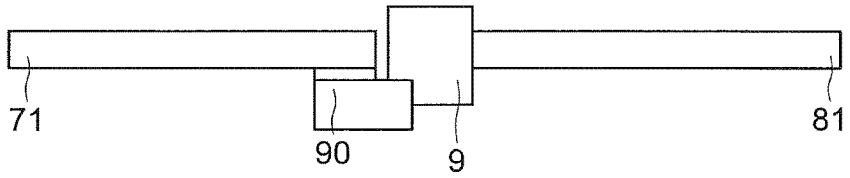
FIG. 7 is a diagram showing an example of attaching a sensor unit and a light blocking plate to the trays.
Figure 8:
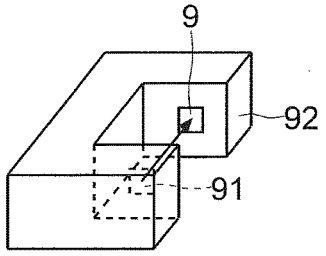
FIG. 8 is a diagram showing an example of each sensor unit.
Figure 10:
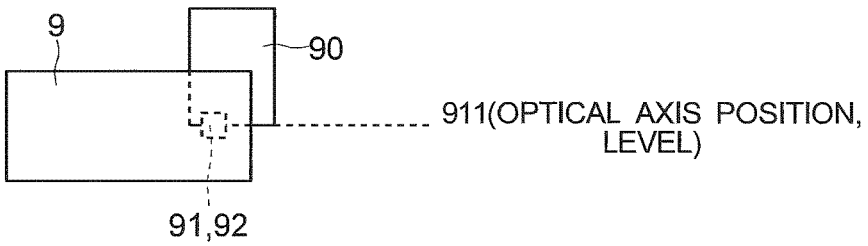
FIG. 10 is a diagram showing an example of a position of the light blocking plate with respect to an optical axis of the sensor unit.

Accordingly, the paper feeding device 1 uses only a sensor unit 9 and a light blocking plate 90 to raise the two trays while maintaining the substantially same height of them (see FIG. 7). Specifically, the sensor unit 9 is attached to the left tray 71 (first tray) to check a position of the right tray 81 (second tray). The sensor unit 9 is attached at a position that does not interfere with the separation plate 11, namely under the left tray 71 at a right front side or at a right rear side. The sensor unit 9 is a transparent type optical sensor as shown in FIGS. 8 and 10. Note that the sensor unit 9 is not limited to the transparent type optical sensor. It is possible to use a sensor that can detect a position of the right tray 81 and enables to detect that the left tray 71 and the right tray 81 become the same height.

Figure 9:
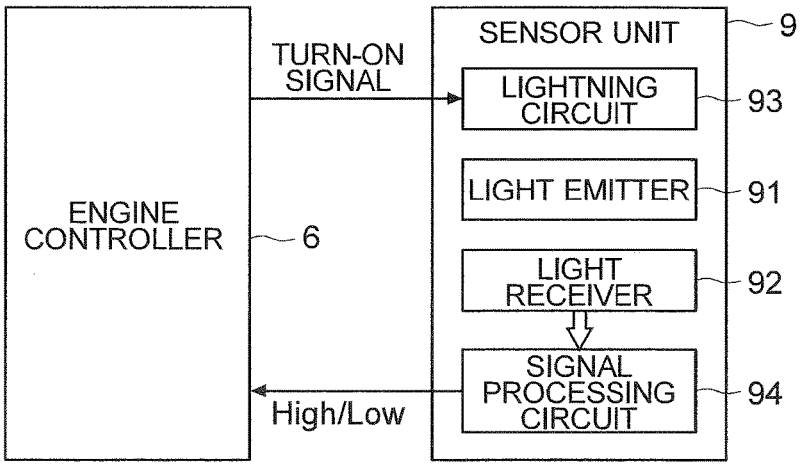
FIG. 9 is a diagram showing an example of each sensor unit.

As shown in FIGS. 8 and 10, the sensor unit 9 includes a light emitter 91 (e.g., and LED) for emitting light to a light receiver 92, and the light receiver 92 for receiving the light from the light emitter 91 so as to output current (voltage) corresponding to a received light amount. In addition, as shown in FIG. 9, there is disposed a lightning circuit 93 that controls the light emitter 91 to emit light on the basis of a signal from the engine controller 6 instructing to turn on light, and controls the light emitter 91 to stop emission on the basis of a signal instructing to turn off light.

Further, the light blocking plate 90 is attached to the right tray 81. The light blocking plate 90 is disposed at a position corresponding to a recess part of the sensor unit 9. The light blocking plate 90 blocks between the light emitter 91 and the light receiver 92 of the sensor unit 9 or lets the light pass through in accordance with a height of the right tray 81. In other words, the light blocking plate 90 is attached to such a position that the light blocking plate 90 passes between the light emitter 91 and the light receiver 92 of the sensor unit 9 when the right tray 81 goes up and down.

The output of the light receiver 92 is input to a signal processing circuit 94 of the sensor unit 9. Note that the signal processing circuit 94 may be disposed in the engine controller 6. Further, the signal processing circuit 94 outputs High or Low depending on whether or not an output value of the light receiver 92 is a predetermined threshold value or higher. An output of the sensor unit 9 (signal processing circuit 94) is input to the engine controller 6. Here, in this description, there is described an example in which the sensor unit 9 (signal processing circuit 94) outputs High (ON) as a signal indicating that the light is blocked by the light blocking plate 90 (light blocking output value), while it outputs Low (OFF) as a signal indicating that the light is not blocked by the light blocking plate 90 but passes through (transparent output value). Note that the logic may be inverted.

Specifically, the light blocking plate 90 is attached to such a position that the output of the sensor unit 9 changes from Low to High (from the transparent output value to the light blocking output value) when the left tray 71 and the right tray 81 become the same height. Specifically, the light blocking plate 90 is attached so that a lower edge of the light blocking plate 90 coincides with an optical axis 911 of the light emitter 91 and the light receiver 92 when the left tray 71 and the right tray 81 become the same height (see FIG. 10, a position of the optical axis 911 is shown by a broken line in FIG. 10). In other words, a threshold value of the signal processing circuit 94 is an output value of the light receiver 92 when the lower edge of the light blocking plate 90 coincides with the optical axis 911 of the light emitter 91 and the light receiver 92. In this way, the engine controller 6 can check whether or not the left tray 71 and the right tray 81 become the same height by checking a change of the output of the sensor unit 9. Then, the engine controller 6 controls ON/OFF of the first elevation motor (left elevation motor 74) and ON/OFF of the second elevation motor (right elevation motor 84).

(Flow of Process of Tray Elevation in Tray Parallel Elevation Mode)

Figure 11:
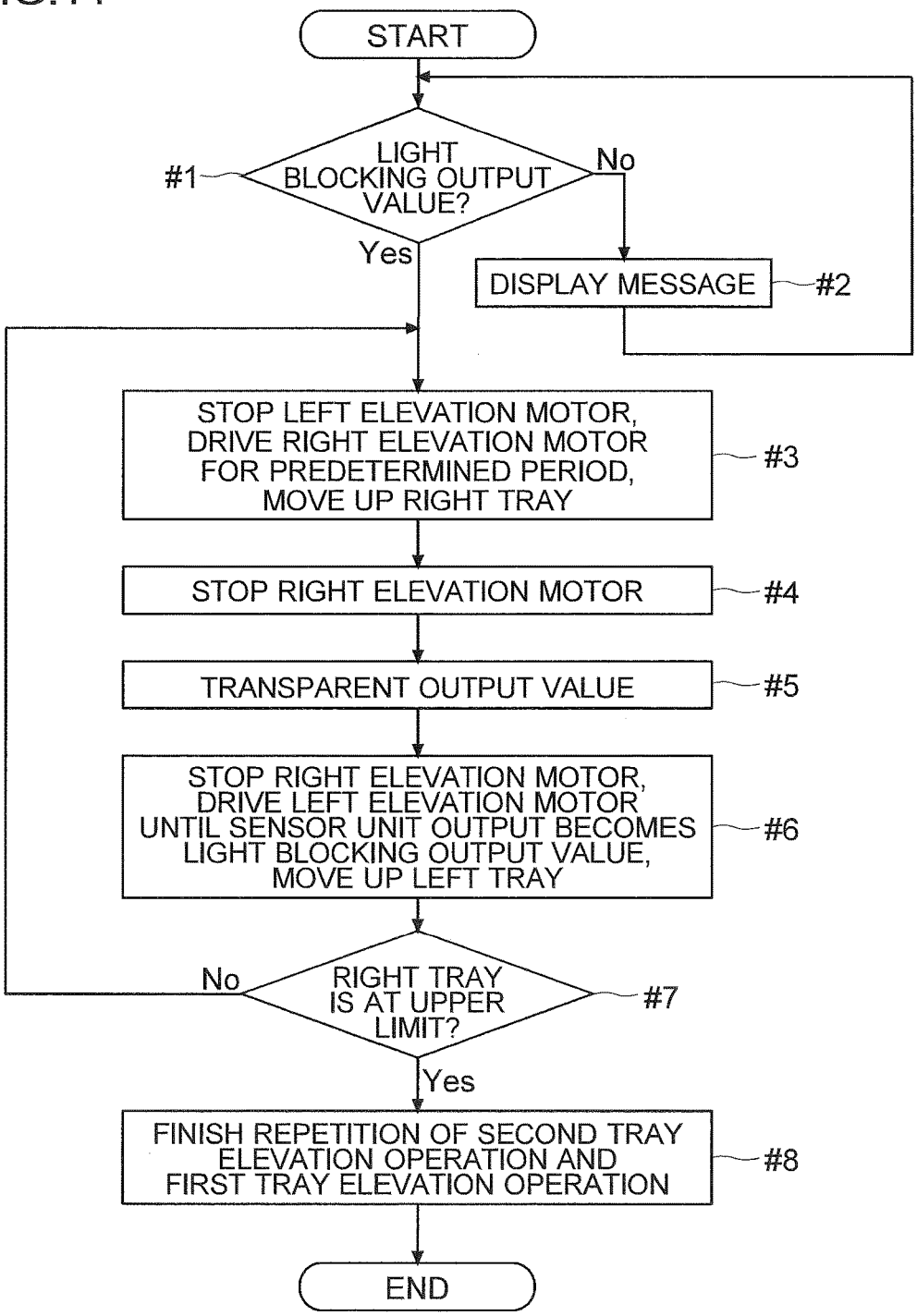
FIG. 11 is a flowchart showing an example of a flow of a process in the tray parallel elevation mode.
Figure 12:
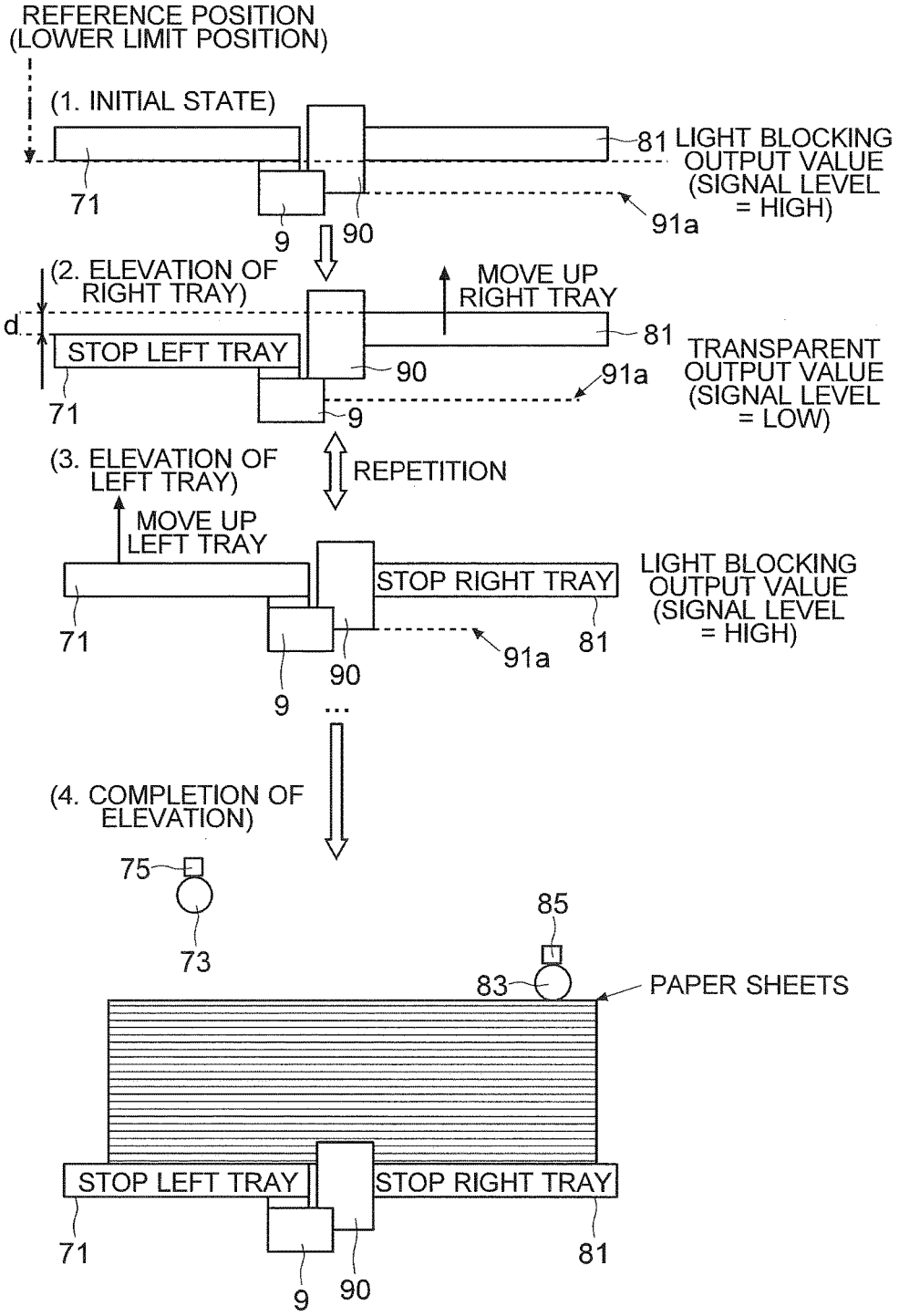
FIG. 12 is a diagram for explaining tray elevation in the tray parallel elevation mode.

Next, with reference to FIGS. 11 and 12, an example of a flow of a process of the tray elevation in the tray parallel elevation mode is shown.

First, start of the flowchart shown in FIG. 11 is described. The engine controller 6 starts the parallel elevation of the both trays in the tray parallel elevation mode under a condition that the separation plate 11 of the paper feeding device 1 is removed. The engine controller 6 recognizes that the separation plate 11 is removed on the basis of the output of the separation plate sensor S2. Without disposing the separation plate sensor S2, it is possible to make an input indicating that the separation plate 11 is removed by operation of the operation panel 2. Accordingly, the engine controller 6 may recognize that the separation plate 11 is removed on the basis of the input to the operation panel 2.

In addition, the engine controller 6 starts to raise the both trays to the paper feed position in the tray parallel elevation mode under a condition that the housing 10 of the paper feeding device 1 is drawn out and pushed back (opened and closed). Alternatively, the engine controller 6 starts the same under a condition that the power supply to the paper feeding device 1 is started when the main power is turned on or the power save mode is canceled. When the housing 10 is opened and closed, the both trays (the left tray 71 and the right tray 81) move down to the reference position (lower limit position). It is necessary for the elevation that the both trays are moved down to the reference position. In addition, because the both trays have the same reference position (the lowest position), the both trays become the same height. Further, when the housing 10 is opened and closed, the separation plate 11 may be removed and the paper sheets may be placed to stride over the both trays.

The flow of FIG. 11 starts when the condition for starting the parallel elevation of the both trays (the left tray 71 and the right tray 81) in the tray parallel elevation mode is satisfied.

First, when the tray parallel elevation mode starts, the engine controller 6 checks whether or not the output value of the sensor unit 9 is the light blocking output value (whether or not the left tray 71 and the right tray 81 are substantially the same height) (Step #1). When the output value of the sensor unit 9 is the transparent output value (No in Step #1), the both trays are not at the lower limit (reference position) and heights of the both trays are largely different from each other. When the tray is moved up in this state, the stored (placed) stack of paper sheets may be collapsed.

Accordingly, in the case of the transparent output value, the engine controller 6 controls the display unit 21 of the operation panel 2 to display a message to open the housing 10 or a message to perform inspection because heights of the both trays are different from each other at present (Step #2). When an operation to a confirmation key (not shown) displayed on the screen is accepted by the touch panel 22, the flow returns to Step #1.

On the other hand, when the engine controller 6 confirms that the output of the sensor unit 9 is the light blocking output value (a height of the left tray 71 and a height of the right tray 81 are so close to each other that the light blocking plate 90 blocks the light) (Yes in Step #1; the state of "1. Initial state" in FIG. 12), the engine controller 6 stops the left elevation motor 74 and moves up the right tray 81 so that the height difference d between the left tray 71 and the right tray 81 becomes within the permissible range (drives the right elevation motor 84 for a predetermined period of time; a second tray elevation operation in Step #3). After driving for a predetermined period of time, the engine controller 6 stops the right elevation motor 84 (Step #4; the state of "2. Elevation of right tray 81" in FIG. 12). As a result of driving for a predetermined period of time, the output of the sensor unit 9 becomes the transparent output value, and the engine controller 6 recognizes that the output of the sensor unit 9 has become the transparent output value (Step #5).

When the output of the sensor unit 9 does not become the transparent output value after driving the right elevation motor 84 for a predetermined period of time, the engine controller 6 may further rotate the right elevation motor 84 for a predetermined period of time. When the output of the sensor unit 9 does not become the transparent output value after a total time during which only the right elevation motor 84 is rotated exceeds a predetermined limit time, the sensor unit 9 may be broken down, or the light blocking plate 90 may be removed, or other trouble may have occurred. Accordingly, the engine controller 6 may control the operation panel 2 to display an error.

A length of the "permissible range" is appropriately determined. For instance, the length (height) of the "permissible range" is 0.5 mm to 1 mm to a few mm. For instance, it is possible to determine the permissible range from an experiment, which is the height difference d between the left tray 71 and the right tray 81 such that the stack of paper sheets is not collapsed and no problem occurs in feeding the paper sheet after moving up to the paper feed position, by changing the number of the paper sheets placed to stride over the both trays and rotating the right elevation motor 84.

When the right elevation motor 84 is rotated in the state where the left tray 71 and the right tray 81 are at the same height, the output of the sensor unit 9 becomes the transparent output value. Accordingly, the "predetermined period of time" is equal to or longer than the time necessary for moving up the second tray from the state where the lower edge of the light blocking plate 90 coincides with the optical axis 911 of the light emitter 91 (the state of the light blocking output value) to the position to be the transparent output value. In addition, the "predetermined period of time" is set to a rotation time of the right elevation motor 84 such that the height difference d between the left tray 71 and the right tray 81 becomes within the permissible range. Accordingly, the "predetermined period of time" is determined on the basis of the output change of the sensor unit 9 and the permissible range. Although depending on the motor to be used, the "predetermined period of time" is approximately 10 msec to a few tens msec, for example.

Next, the engine controller 6 stops the right elevation motor 84 and controls the left elevation motor 74 to move up the left tray 71 until the output of the sensor unit 9 becomes the light blocking output value (Step #6; the first tray elevation operation; the state of "3. Elevation of left tray 71" in FIG. 12). In this way, the left tray 71 is moved up so as to catch up with the position of the right tray 81.

Further, the engine controller 6 checks the output of the right upper limit sensor 85. When the stack of paper sheets contacts with the right paper feed roller 83, the right paper feed roller 83 that can swing in the up and down direction is lifted up by the right tray 81 and the paper sheet to become the paper feed position (upper limit position). Then, the output value of the right upper limit sensor 85 changes. The engine controller 6 checks whether or not this change is recognized (Step #7).

When the right paper feed roller 83 has not reached the paper feed position (No in Step #7), the flow returns to Step #2. As a result, until reaching the paper feed position, the engine controller 6 maintains the height difference d between the both trays within the permissible range and alternately repeats the second tray elevation operation and the first tray elevation operation. As a result, the both trays are at the same height while being moved up.

On the other hand, when the right paper feed roller 83 (right tray 81) reaches the paper feed position (Yes in Step #7; the state of "4. Completion of elevation" in FIG. 12), the engine controller 6 finishes the repetition of the second tray elevation operation and the first tray elevation operation (Step #8). Then, this flow is finished (END).

The paper feeding device 1 includes the paper feed rollers (the left paper feed rollers 73 and the right paper feed rollers 83) for the both trays so that paper feed can be performed from each of the trays. In addition, the left upper limit sensor 75 is provided so as to detect that the left tray 71 has reached the paper feed position when the top sheet of the paper sheets placed on the left tray 71 contacts with the left paper feed roller 73. In addition, the right upper limit sensor 85 is provided so as to detect that the right tray 81 has reached the paper feed position when the top sheet of the paper sheets placed on the right tray 81 contacts with the right paper feed roller 83.

Further, the right paper feed roller 83 is disposed at the position having a smaller paper sheet conveying distance to the print position (image forming portion 4*b*) than the left paper feed roller 73. The right paper feed roller 83 and the right upper limit sensor 85 are disposed at a position lower than the left paper feed roller 73 and the left upper limit sensor 75. Further, when moving up the stack of paper sheets until the top paper sheet contacts with the left paper feed roller 73, the right paper feed roller 83 may be an obstacle. In addition, even if the left paper feed roller 73 is rotated, large size paper sheets placed to stride over the left tray 71 and the right tray 81 cannot be conveyed to the conveying portion 4*a*.

Accordingly, in the tray parallel elevation mode, the engine controller 6 controls the left tray 71 and the right tray 81 to move up until the paper feed position of the right tray 81 on the basis of the right upper limit sensor 85, and controls the right paper feed roller 83 to rotate so that the paper sheets placed to stride over the left tray 71 and the right tray 81 can be fed. In other words, large size paper sheets are set to be fed from the right paper feed roller 83.

In the paper feeding device 1 including a plurality of trays disposed side by side in one casing, inexpensive DC motors (brush motors) are used because a large torque can be easily obtained for moving up the trays on which a large number of paper sheets are placed. However, it is difficult for the inexpensive brush motors to rotate at the same speed so that the trays move up at the same speed while maintaining the same height of the trays, because the rotation speeds change depending on loads, and the rotation speeds of the motor have a variation (individual difference) even if the same voltage and the same current are supplied.

Accordingly, the paper feeding device 1 according to the embodiment is equipped with the first paper feeding portion 7 including the first tray (left tray 71), the first paper feed roller (left paper feed roller 73), and the first elevation mechanism (left tray elevation mechanism 72), the second paper feeding portion 8 disposed side by side with the first paper feeding portion 7 in the horizontal direction, including the second tray (right tray 81), the second paper feed roller (right paper feed roller 83), and the second elevation mechanism (right tray elevation mechanism 82), the separation plate 11, the sensor unit 9, and the controller (engine controller 6). Further, in the tray parallel elevation mode, the controller (engine controller 6) moves up the first tray and the second tray, by alternately repeating the second tray elevation operation in which the first elevation motor (left elevation motor 74) is stopped while the second elevation motor (right elevation motor 84) is driven to move up the second tray and the first tray elevation operation in which the second elevation motor is stopped while the first elevation motor is driven to move up the first tray, on the basis of the output of the sensor unit 9 so that the height difference d between the first tray and the second tray is within a predetermined permissible range.

In this way, while reducing the height (position) difference d, the first tray (left tray 71) is moved up to catch up with the second tray (right tray 81) that has been moved up first. Accordingly, when a stack of large size paper sheets is placed to stride over a plurality of paper feeding tray, the trays can be moved up to the paper feed roller while maintaining the height difference between the trays within the rage without a problem (without a collapse of the stack of paper sheets or a paper feed error after the elevation). Accordingly, the paper feeding device with the independent trays can feed large size paper sheets that cannot be set in the conventional device. Accordingly, it is possible to provide a multi-tray housing paper feeding device that is easy to use and can be used without a problem when large size paper sheets are set. In addition, even if inexpensive motors such as brush motors are used without using stepping motors and a dedicated driving circuit, the trays can be moved up without collapsing the stack of paper sheets placed to stride over the trays. Accordingly, manufacturing cost is not increased. In addition, because the trays are moved up while maintaining the height difference within the permissible range, there occurs no problem in the actual paper feed (paper feed performance is not decreased).

In addition, when the first tray (left tray 71) becomes the same height as the second tray (right tray 81), the output of the sensor unit 9 changes from the transparent output value indicating the transparent state to the light blocking output value indicating the light blocking state in which the light blocking plate 90 blocks the light. In the tray parallel elevation mode, the controller (engine controller 6) stops the first elevation motor (left elevation motor 74) and rotates the second elevation motor (right elevation motor 84) for a predetermined period of time to move up the second tray so that the output of the sensor unit 9 changes from the light blocking output value to the transparent output value, as second tray elevation operation. After the rotation of the second elevation motor for a predetermined period of time, the controller (engine controller 6) stops the second elevation motor and rotates the first elevation motor to move up the first tray until the output of the sensor unit 9 changes from the light blocking output value to the light blocking output value, as the first tray elevation operation.

In this way, the trays are moved up in such a manner that one of the trays is moved up first, and the other is moved up to catch up with the one. Then, the trays maintain substantially the same height. Accordingly, although the first tray and the second tray are alternately moved up, the height difference d is very small. Further, although the inexpensive motors such as brush motors are used, the first tray and the second tray can be moved up maintaining substantially the same height.

In addition, in the tray parallel elevation mode, on the basis of the second upper limit switch, the controller (engine controller 6) moves up the first tray and the second tray to the paper feed position of the second tray and controls the second paper feed roller to rotate so as to feed paper sheets placed to stride over the first tray and the second tray. In this way, the trays are moved up with respect to the position at which the lower paper feed roller can feed the paper sheet as the upper limit position, and hence the time necessary for moving up the both trays can be short. In addition, the paper sheets placed to stride over the first tray and the second tray can be quickly sent to the print position (image forming portion).

When a predetermined condition for lowering such as drawing out of the trays of the paper feeding device 1, heights of the first tray and the second tray become equal to each other. In this way, when paper sheets are placed to stride over the first tray and the second tray, the stack of the paper sheets is not collapsed at the time point of placing. In addition, the first tray and the second tray can be maintained at substantially the same height from beginning of the elevation operation.

In addition, the image forming apparatus (multifunction peripheral 100) includes the paper feeding device 1 according to the embodiment, namely the multi-tray housing paper feeding device, which can store large size paper sheets that cannot be set in the conventional device, and can be used without a problem when large size paper sheets are set. Accordingly, it is possible to provide an image forming apparatus that can be easily used. In addition, because it is more convenient than the conventional device, and an increase of cost for manufacturing the paper feeding device 1 can be suppressed, it is possible to provide an image forming apparatus having high cost competitiveness.

(Variation 1)

Figure 13:
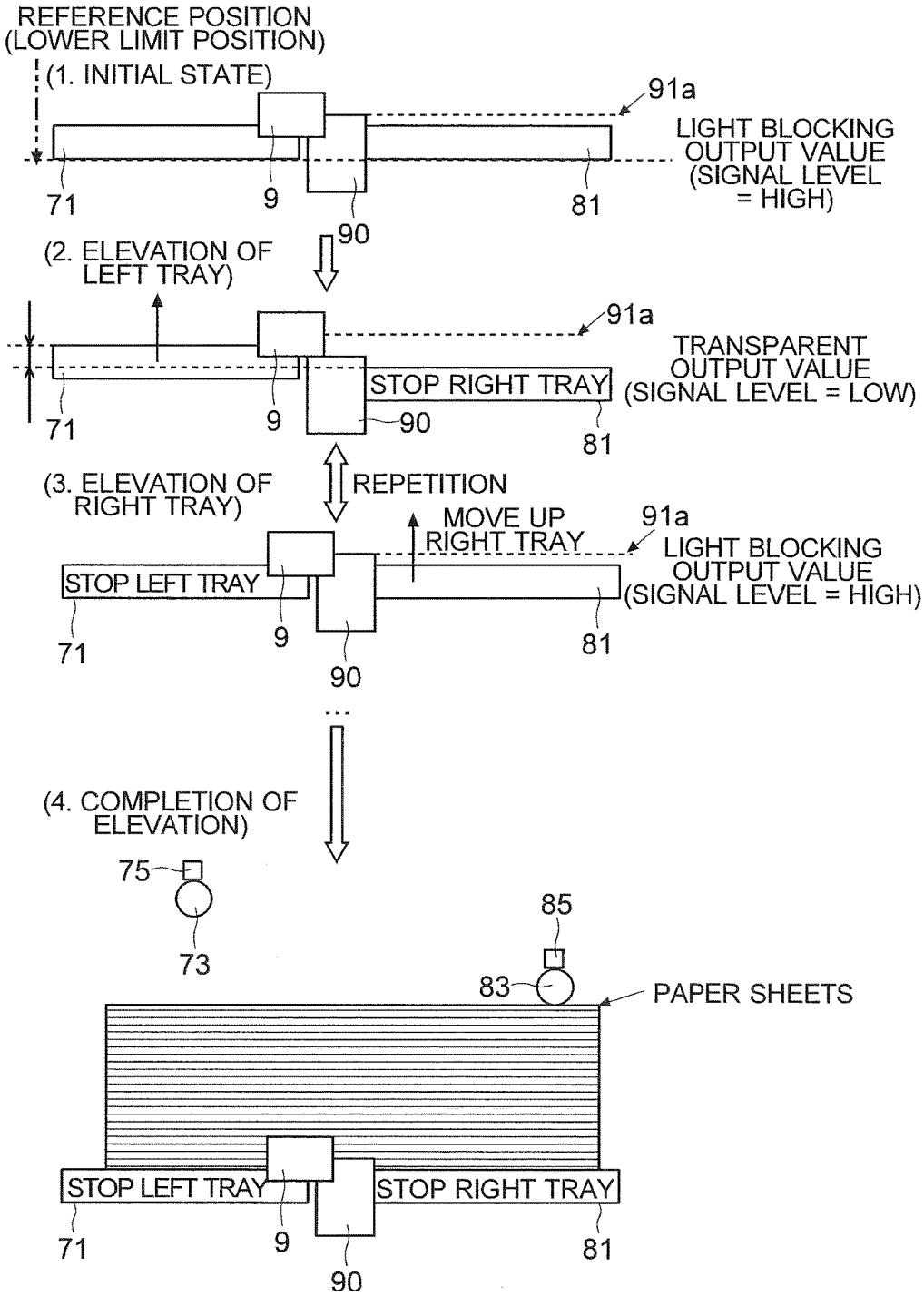
FIG. 13 is a diagram for explaining Variation 1.

With reference to FIG. 13, Variation 1 is described. In the above description of the embodiment, there is described an example in which in the tray parallel elevation mode, when the output of the sensor unit 9 is the light blocking output value, the right tray 81 is moved up, and after the right tray 81 is moved up, the left tray 71 is moved up so that the left tray 71 follows the right tray 81. However, it is possible to configure as shown in FIG. 13, in which when the output of the sensor unit 9 is the light blocking output value, the left tray 71 is moved up, and after the left tray 71 is moved up, the right tray 81 is moved up so that the right tray 81 follows the left tray 71.

In this case, similarly to the embodiment described above, the sensor unit 9 including the transparent type optical sensor should be provided to the left tray 71. In addition, the light blocking plate 90 should be attached to the right tray 81. Further, in this variation, as shown in FIG. 13 as individual states, the light blocking plate 90 is attached so that an upper edge of the light blocking plate 90 coincides with the optical axis 911 of the light emitter 91 and the light receiver 92 when the left tray 71 and the right tray 81 become the same height. Further, when the right tray 81 is moved up so that the left tray 71 and the right tray 81 become the same height, the output of the sensor unit 9 changes from the transparent output value indicating the transparent state to the light blocking output value indicating the light blocking state in which the upper edge of the light blocking plate 90 blocks the light.

Further, in the tray parallel elevation mode, when the output value of the sensor unit 9 is the light blocking output value ("1. Initial state" in FIG. 13), the engine controller 6 stops the right elevation motor 84 and rotates the left elevation motor 74 for a predetermined period of time so that the first tray is moved up. The output of the sensor unit 9 becomes the transparent output value ("2. Elevation of left tray 71" in FIG. 13). After the left elevation motor 74 is rotated for a predetermined period of time, the engine controller 6 stops the left elevation motor 74 and rotates the right elevation motor 84 until the output of the sensor unit 9 is changed to the light blocking output value ("3. Elevation of right tray 81" in FIG. 1). The process from "1. Initial state" to "3. Elevation of right tray 81" in FIG. 13 is repeated, and as a result, the left tray 71 and the right tray 81 are moved up to the paper feed position while maintaining substantially the same height ("4. Completion of elevation" in FIG. 13).

In other words, in this variation, in the tray parallel elevation mode, the controller (engine controller 6) stops the second elevation motor (right elevation motor 84) and rotates the first elevation motor (left elevation motor 74) for a predetermined period of time to move up the first tray so that the output of the sensor unit 9 changes from the light blocking output value to the transparent output value, as the first tray elevation operation. After the first elevation motor is rotated for a predetermined period of time, the controller stops the first elevation motor and rotates the second elevation motor so that the second tray is moved up until the output of the sensor unit 9 changes from the transparent output value to the light blocking output value, as the second tray elevation operation.

In this way, in the case where the first tray is moved up first, the trays become substantially the same height when the second tray stops to move up. Accordingly, although the first tray and the second tray are alternately moved up, the height difference d is very small. Further, although the inexpensive motors such as brush motors are used, the trays can be moved up maintaining substantially the same height.

In the embodiment and Variation 1 described above, there is described an example in which the sensor unit 9 is provided to the left tray 71 while the light blocking plate 90 is provided to the right tray 81. However, it is possible to adopt a structure in which the light blocking plate 90 is provided to the left tray 71 while the sensor unit 9 is provided to the right tray 81.

(Variation 2)

Next, with reference to FIGS. 14 to 17, Variation 2 is described. Variation 2 is different from the embodiment described above in that the two optical sensors (an upper sensor unit 9*a* and a lower sensor unit 9*b*) are disposed in the sensor unit 9, the light blocking plate 90 is disposed, and in the process of the tray parallel elevation mode. However, other points are the same.

Figure 14:
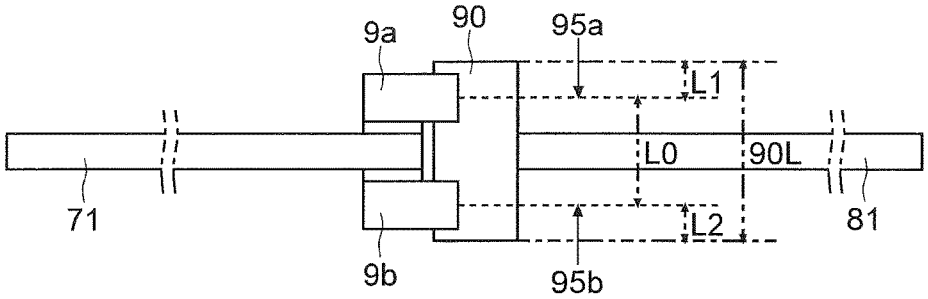
FIG. 14 is a diagram showing an example of attaching an upper sensor unit 9*a*, a lower sensor unit 9*b*, and a light blocking plate 90 to the trays in Variation 2.

In the paper feeding device 1 of Variation 2, only the two optical sensors (the upper sensor unit 9*a* and the lower sensor unit 9*b*) and the light blocking plate 90 are used for moving up the two trays while maintaining substantially the same heights of the two trays. As shown in FIG. 14, the upper sensor unit 9*a* and the lower sensor unit 9*b* are attached to the left tray 71 (first tray). The upper sensor unit 9*a* includes a transparent type optical sensor disposed on the upper surface side of the left tray 71. The lower sensor unit 9*b* includes a transparent type optical sensor disposed on the lower surface side of the left tray 71. These optical sensors are attached at positions that do not interfere with the separation plate 11, at a right front side or right rear side corner of the left tray 71. The upper sensor unit 9*a* and the lower sensor unit 9*b* can be the same type (sensors having the same specification). The upper sensor unit 9*a* and the lower sensor unit 9*b* are both the transparent type optical sensor as shown in FIG. 15.

Figure 15:
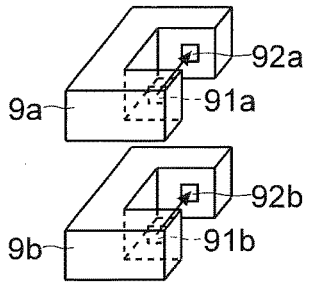
FIG. 15 is a diagram showing an example of the sensor units in Variation 2.
Figure 16:
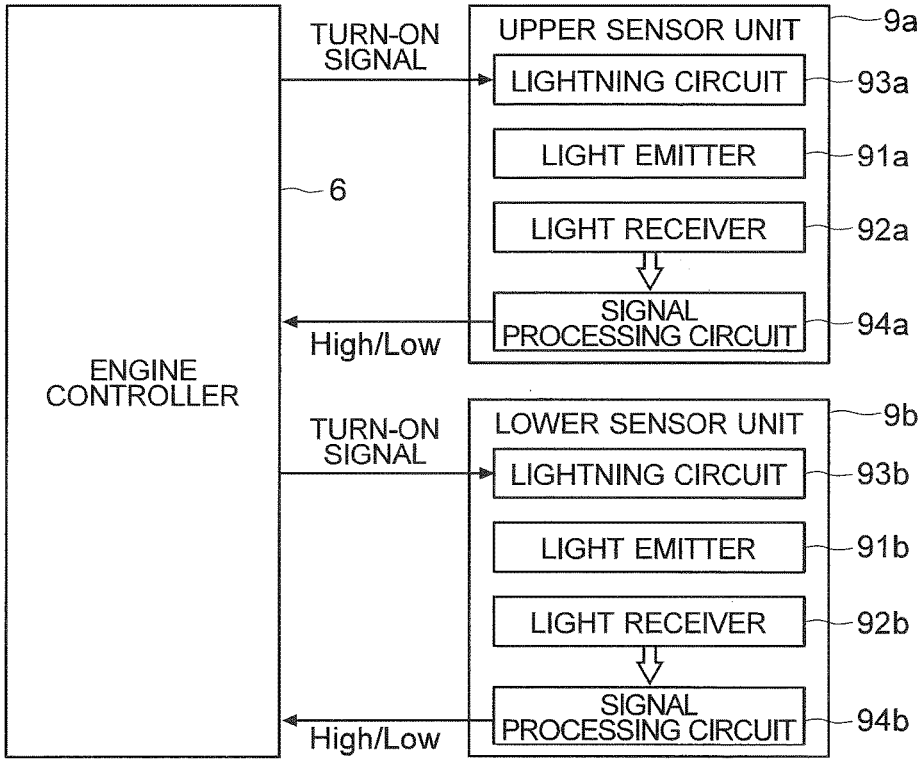
FIG. 16 is a diagram showing an example of the sensor units in Variation 2.

As shown in FIG. 15, the upper sensor unit 9*a* includes a light emitter 91*a* (e.g., an LED) for emitting light to a light receiver 92*a* and the light receiver 92*a* for receiving the light from the light emitter 91*a* so as to output current (voltage) corresponding to a received light amount. In addition, as shown in FIG. 16, there is disposed a lightning circuit 93*a* for turning on the light emitter 91*a* to emit light on the basis of a signal instructing to turn on light from the engine controller 6 and for turning off the light emitter 91*a* on the basis of a signal instructing to turn off light.

In addition, similarly to the upper sensor unit 9*a*, the lower sensor unit 9*b* includes a light emitter 91*b* (e.g., an LED) for emitting light to a light receiver 92*b* and the light receiver 92*b* for receiving the light from the light emitter 91*b* so as to output current (voltage) corresponding to a received light amount. In addition, as shown in FIG. 16, there is disposed a lightning circuit 93*b* for turning on the light emitter 91*b* to emit light on the basis of a signal instructing to turn on light from the emission engine controller 6 and for turning off the light emitter 91*b* on the basis of a signal instructing to turn off light.

The light blocking plate 90 is attached to the right tray 81. The light blocking plate 90 is disposed at a position corresponding to recess parts of the upper sensor unit 9*a* and the lower sensor unit 9*b*. The light blocking plate 90 blocks between the light emitter 91*a* and the light receiver 92*a* as well as between the light emitter 91*b* and the light receiver 92*b* or transmits the light depending on the height of the right tray 81. In other words, the light blocking plate 90 is attached to a position such that when the right tray 81 is moved up or down, the light blocking plate 90 passes between the light emitter 91*a* and the light receiver 92*a* of the upper sensor unit 9*a* as well as between the light emitter 91*b* and the light receiver 92*b* of the lower sensor unit 9*b*.

The output of the light receiver 92*a* is input to a signal processing circuit 94*a* of the upper sensor unit 9*a*. Note that the signal processing circuit 94*a* may be disposed in the engine controller 6. The signal processing circuit 94*a* outputs High or Low depending on whether or not the output value of the light receiver 92*a* is a predetermined threshold value or higher. The output of the upper sensor unit 9*a* (signal processing circuit 94*a*) is input to the engine controller 6.

On the other hand, the output of the light receiver 92*b* is input to a signal processing circuit 94*b* of the lower sensor unit 9*b*. Note that the signal processing circuit 94*b* may be disposed in the engine controller 6. The signal processing circuit 94*b* outputs High or Low depending on whether or not the output value of the light receiver 92*b* is a predetermined threshold value or higher. An output of the lower sensor unit 9*b* (signal processing circuit 94*b*) is input to the engine controller 6.

In this description, there is described an example in which the upper sensor unit 9*a* (signal processing circuit 94*a*) and the lower sensor unit 9*b* (signal processing circuit 94*b*) output High (ON) as the output value in the state where the light blocking plate 90 blocks the light (light blocking output value) and outputs Low (OFF) as the output value in the state where the light blocking plate 90 does not block the light to be the transparent state (transparent output value). Note that the logic may be inverted.

The light blocking plate 90 is attached so that when the left tray 71 and the right tray 81 are at the same height, both the outputs of the upper sensor unit 9*a* and the lower sensor unit 9*b* are the light blocking output value (High). In addition, a length 90L of the light blocking plate 90 in the up and down direction is longer than an inter-optical axis distance L0 between (a level of) an optical axis 95*a* of the optical sensor of the upper sensor unit 9*a* and (a level of) an optical axis 95*b* of the optical sensor of the lower sensor unit 9*b* (see FIG. 14). Further, in FIG. 14 and following figures, positions (levels) of the optical axis 95*a* of the upper sensor unit 9*a* and the optical axis 95*b* of the lower sensor unit 9*b* are shown by broken lines.

Further, outputs of the upper sensor unit 9*a* and the lower sensor unit 9*b* are switched between Low and High (between the transparent output value and the light blocking output value) when (a level of) the optical axis of the optical sensor coincides with the upper or lower edge of the light blocking plate 90. Accordingly, a threshold value of the signal processing circuit 94*a* is the output value of the light receiver 92*a* when the edge of the light blocking plate 90 coincides with the optical axis 95*a*, and a threshold value of the signal processing circuit 94*b* is the output value of the light receiver 92*b* when the edge of the light blocking plate 90 coincides with the optical axis 95*b*.

When the trays 71 and 81 are at the same height, the upper edge of the light blocking plate 90 is positioned higher than the left tray 71 and the right tray 81. In addition, the lower edge is positioned lower than the left tray 71 and the right tray 81. The light blocking plate 90 is disposed to block both the optical sensors of the upper sensor unit 9*a* and the lower sensor unit 9*b* when the both trays are at the same height. In addition, the length 90L of the light blocking plate 90 in the up and down direction is equal to or smaller than a length obtained by adding the inter-optical axis distance to a value that is a limit value or smaller.

Here, the limit value is a value indicating a limit of the height difference between the trays 71 and 81 in the tray parallel elevation mode. The limit value is determined on the basis of an experiment or the like considering that paper feed can be appropriately performed after the elevation and that the stack of paper sheets is not collapsed. The limit value is approximately 1 to 4 mm. Further, the light blocking plate 90 may be attached so that when the first tray and the second tray are at the same height, the center between the level of the optical axis 95*a* of the optical sensor of the upper sensor unit 9*a* and the level of the optical axis 95*b* of the optical sensor of the lower sensor unit 9*b* (the center of the inter-optical axis distance) coincides with the center of the light blocking plate 90 in the up and down direction.

When the trays 71 and 81 are at the same height, an upper protruding length L1 from the level of the optical axis 95*a* of the optical sensor of the upper sensor unit 9*a* to the upper edge of the light blocking plate 90 may be the same as a lower protruding length L2 from the level of the optical axis 95*b* of the optical sensor of the lower sensor unit 9*b* to the lower edge of the light blocking plate 90. The upper protruding length L1 and the lower protruding length L2 are determined by considering output change region widths (e.g., approximately ±0.3 mm) of the optical sensor of the upper sensor unit 9*a* and the optical sensor of the lower sensor unit 9*b*, an attachment error, and tolerance of length of a sheet metal. Accordingly, the upper protruding length L1 and the lower protruding length L2 are approximately 0.5 to 1 mm, for example. As the upper protruding length L1 and the lower protruding length L2 are shorter (As the length 90L of the light blocking plate 90 in the up and down direction is closer to the inter-optical axis distance), the height difference between the both trays when the elevation is completed or during the elevation can be smaller. However, when the error or the tolerance is large, even if the both trays are at the same height, both the output of the upper sensor unit 9*a* and the output of the lower sensor unit 9*b* may be the transparent output value. For this reason, the upper protruding length L1 and the lower protruding length L2 are set to be longer than the tolerance.

In this way, although a certain error is generated, in the tray parallel elevation mode, the height difference between the both trays is maintained to be smaller than a half of the length obtained by subtracting the inter-optical axis distance from the length 90L (smaller than a half of the limit value) while moving up the both trays (details will be described later).

(Flow of Process of Tray Elevation in Tray Parallel Elevation Mode)

Figure 17:
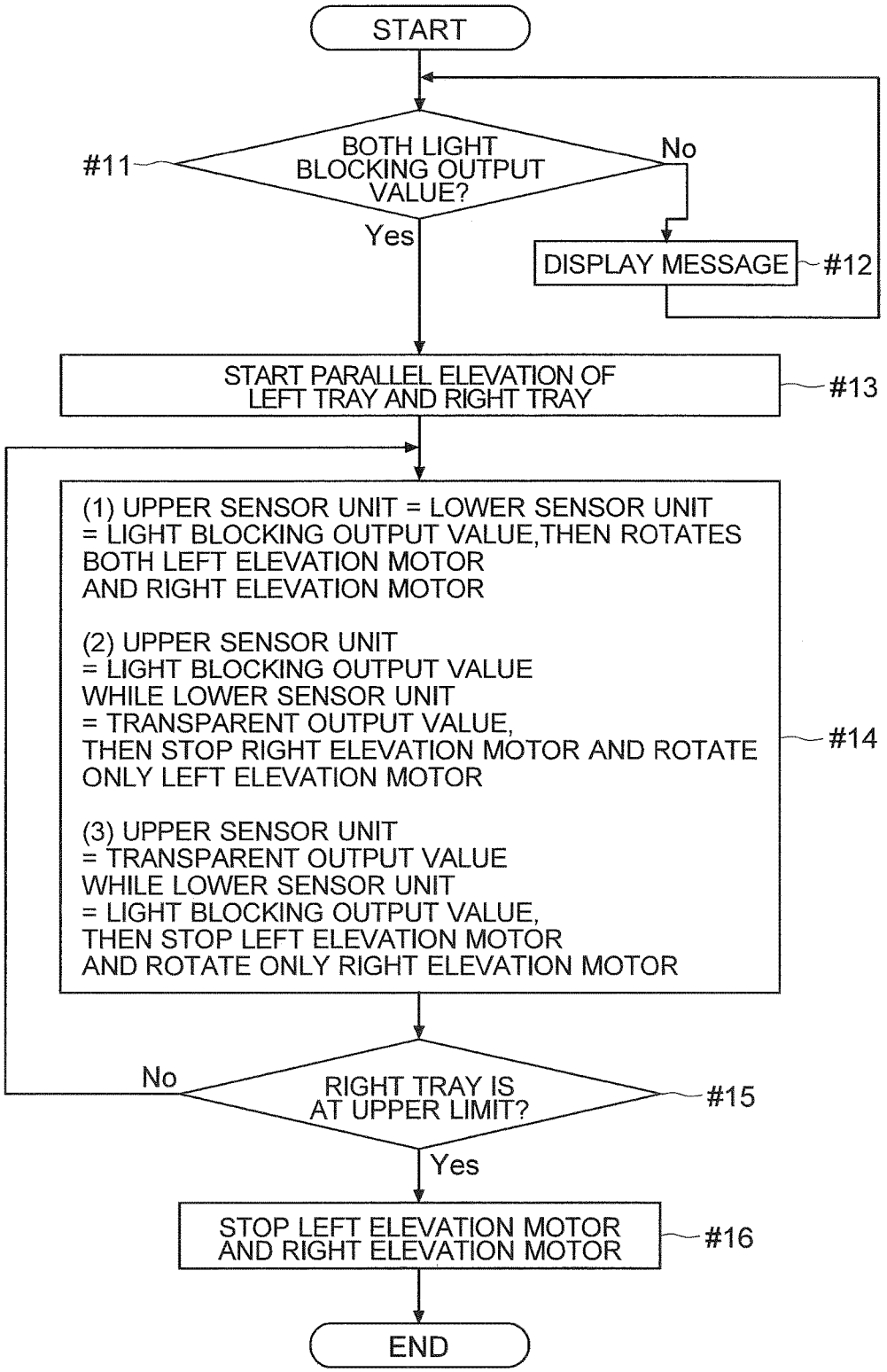
FIG. 17 is a flowchart showing an example of a flow of a process in the tray parallel elevation mode in Variation 2.
Figure 18:
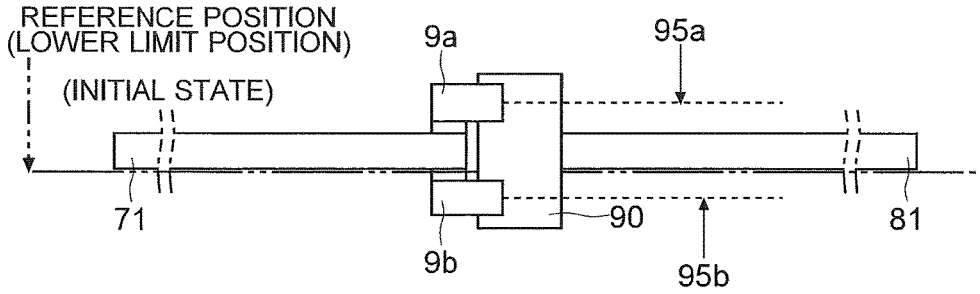
FIG. 18 is a diagram showing an example of a moving-up process of the both trays in the tray parallel elevation mode.

Next, with reference to FIG. 17 to FIG. 22, an example of a flow of the process of the tray elevation in the tray parallel elevation mode is described. FIG. 17 is a flowchart showing an example of a flow of the process in the tray parallel elevation mode. FIGS. 18 to 22 are diagrams showing an example of an elevation process of the both trays in the tray parallel elevation mode.

First, the flowchart of FIG. 17 starts in the same manner as in FIG. 11. The both trays (the left tray 71 and the right tray 81) are moved down to the reference position (lower limit position) when the housing 10 is opened and closed. The elevation of the both trays to the paper feed position in the tray parallel elevation mode is started under the same condition as in FIG. 11. The flow of FIG. 17 starts when the condition for starting the parallel elevation of the both trays (the left tray 71 and the right tray 81) in the tray parallel elevation mode is satisfied.

First, the engine controller 6 checks whether or not both of the output values of the upper sensor unit 9*a* and the lower sensor unit 9*b* are the light blocking output value (whether or not the left tray 71 and the right tray 81 are at the same height; whether or not the both trays are at the reference position) (Step #11). When one of them is at the transparent output value (No in Step #11), the both trays may not be moved down to the lower limit (reference position), and hence the heights of the both trays may be largely different. When the trays are moved up in this state, the stack of paper sheet may be collapsed. In addition, a positional displacement, removal, or other problem may have occurred in the light blocking plate 90, or a positional displacement, a breakdown or other problem may have occurred in the sensor unit of the upper sensor unit 9*a* or the lower sensor unit 9*b*.

Accordingly, at the transparent output value, the engine controller 6 controls the display unit 21 of the operation panel 2 to display a message urging to open and close the housing 10 again or a message to inspect the light blocking plate 90 or the sensors because the heights of the both trays are currently different (Step #12). When an operation to the confirmation key (not shown) displayed on the screen is accepted by the touch panel 22, the flow returns to Step #11.

On the other hand, when the engine controller 6 confirms that both the output values of the upper sensor unit 9*a* and the lower sensor unit 9*b* are the light blocking output value (heights of the left tray 71 and the right tray 81 are close to each other) (Yes in Step #11; the state of FIG. 18), the engine controller 6 starts the parallel elevation process of the both trays (the left tray 71 and the right tray 81) (Step #13).

Further, the engine controller 6 moves up the both trays by the following method (Step #14).

(1) When the output of the upper sensor unit 9*a* is the light blocking output value and the output of the lower sensor unit 9*b* is also the light blocking output value, the engine controller 6 rotates both the left elevation motor 74 and the right elevation motor 84.

Brush motors are used for the left elevation motor 74 and the right elevation motor 84. Because of an individual difference of rotation speed or the like, elevation speeds of the left tray 71 and the right tray 81 are usually different from each other.

Figure 19:
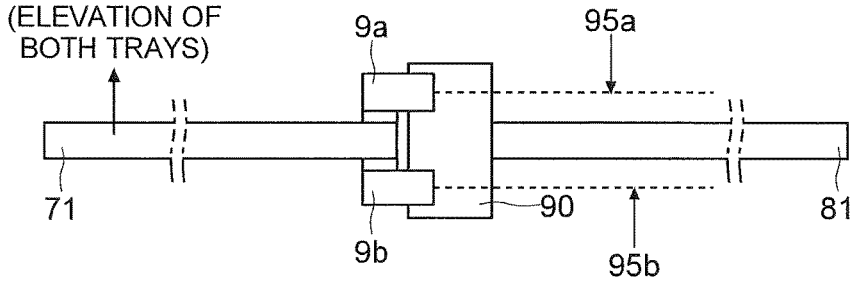
FIG. 19 is a diagram showing an example of the moving-up process of the both trays in the tray parallel elevation mode.

In the state where heights of the both trays are close to each other as shown in FIG. 19 (the state where both the outputs of the upper sensor unit 9*a* and the lower sensor unit 9*b* are the light blocking output value), there is small difference between heights of the both trays. In addition, when the height difference is not large, there occurs no malfunction such that the stack of paper sheets is collapsed or that the paper feed cannot be appropriately performed after the elevation is completed. Accordingly, as shown in FIG. 19, the engine controller 6 rotates both the left elevation motor 74 and the right elevation motor 84 so as to move up both the left tray 71 and the right tray 81.

(2) When the output of the upper sensor unit 9*a* is the light blocking output value while the output of the lower sensor unit 9*b* is the transparent output value, the engine controller 6 stops the right elevation motor 84 and rotates only the left elevation motor 74.

Figure 20:
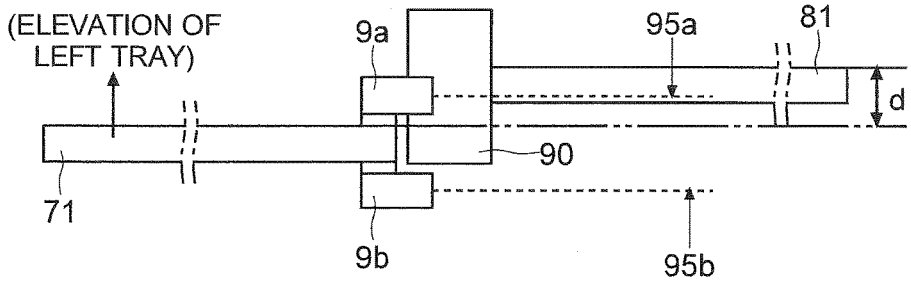
FIG. 20 is a diagram showing an example of the moving-up process of the both trays in the tray parallel elevation mode.

As shown in FIG. 20, after heights of the left tray 71 and the right tray 81 are equalized, when the output value of the upper sensor unit 9*a* is the light blocking output value while the output of the lower sensor unit 9*b* is the transparent output value, the engine controller 6 recognizes that the right tray 81 is higher while the left tray 71 is lower.

When the right tray 81 is continuously moved up in the state shown in FIG. 20, the height difference between of the both trays becomes too large, and hence there may occur a problem such as a collapse of the stack of paper sheets or a paper feed error after the elevation is completed.

Accordingly, in the state shown in FIG. 20, the engine controller 6 stops the right elevation motor 84 and rotates the left elevation motor 74 to move up only the left tray 71 so as to catch up with the right tray 81.

(3) When the output of the upper sensor unit 9*a* is the transparent output value while the output of the lower sensor unit 9*b* is the light blocking output value, the engine controller 6 stops the left elevation motor 74 and rotates only the right elevation motor 84.

Figure 21:
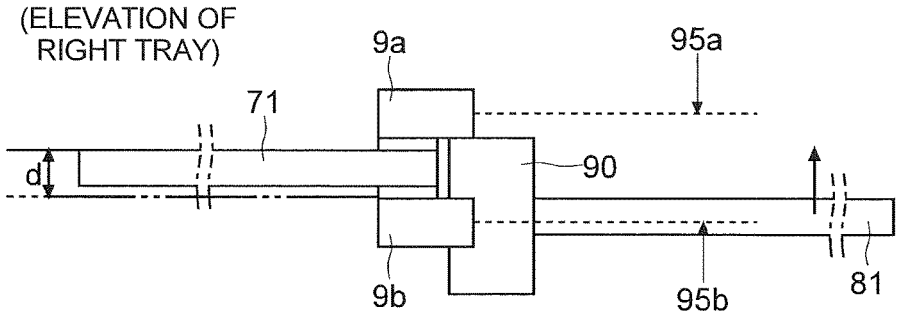
FIG. 21 is a diagram showing an example of the moving-up process of the both trays in the tray parallel elevation mode.
Figure 22:
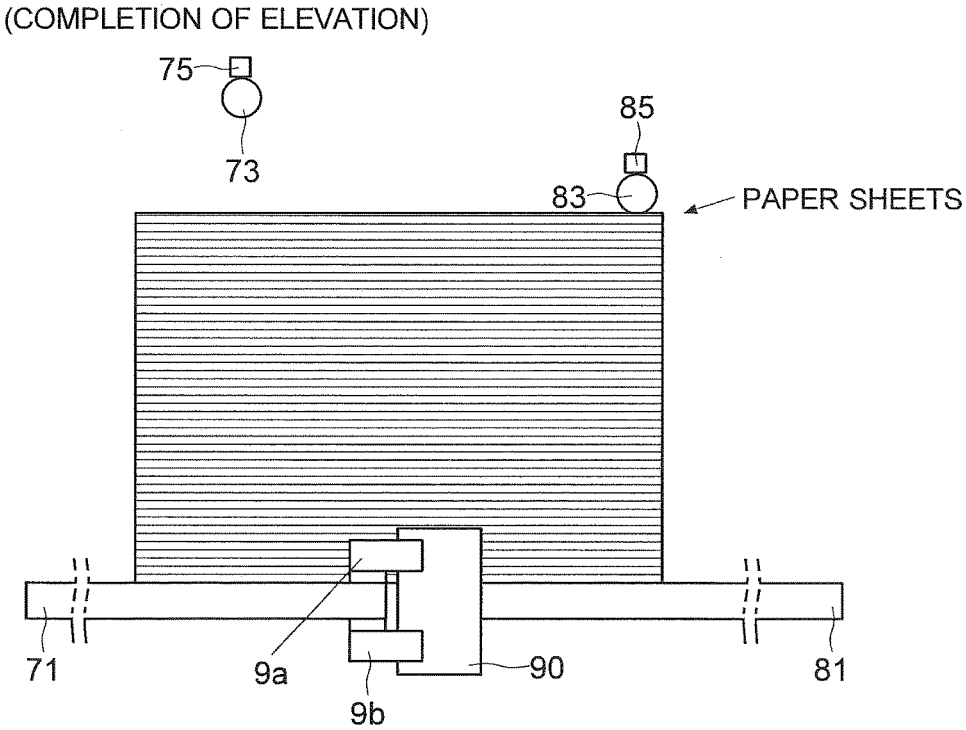
FIG. 22 is a diagram showing an example of the moving-up process of the both trays in the tray parallel elevation mode.

As shown in FIG. 21, after heights of the left tray 71 and the right tray 81 are equalized, when the output value of the upper sensor unit 9*a* is the transparent output value while the output of the lower sensor unit 9*b* is the light blocking output value, the engine controller 6 recognizes that the left tray 71 is higher while the right tray 81 is lower.

When the left tray 71 is continuously moved up in the state shown in FIG. 21, the height difference between the both trays becomes large, and hence there may occur a problem such as a collapse of the stack of paper sheets or a paper feed error after the elevation is completed.

Accordingly, in the state shown in FIG. 21, the engine controller 6 stops the left elevation motor 74 and rotates the right elevation motor 84 to move up only the right tray 81 so as to catch up with the left tray 71.

Further, the engine controller 6 periodically checks the output of the right upper limit sensor 85. Specifically, the engine controller 6 periodically checks the output value of the right upper limit sensor 85, which changes when the top sheet of the stack of paper sheets contacts with the right paper feed roller 83 so that the swinging right paper feed roller 83 is lifted up by the right tray 81 and the paper sheets. The engine controller 6 recognizes this change so as to check whether or not to be the paper feed position (upper limit position) (Step #15).

When the right paper feed roller 83 has not reached the paper feed position (No in Step #15), the flow returns to Step #14. As a result, the engine controller 6 moves up the both trays (the first tray and the second tray) while maintaining the height difference d between the both trays not to become large until reaching the paper feed position.

On the other hand, when the right paper feed roller 83 reaches the paper feed position (Yes in Step #15; the state of FIG. 22), the engine controller 6 stops the left elevation motor 74 and the right elevation motor 84 (Step #16). Then, this flow is finished (END).

The paper feeding device 1 of Variation 2 is equipped with the first paper feeding portion 7 including the first tray (left tray 71), the first paper feed roller (left paper feed roller 73), and the first elevation mechanism (left tray elevation mechanism 72), the second paper feeding portion 8 disposed side by side with the first paper feeding portion 7 in the horizontal direction, including the second tray (right tray 81), the second paper feed roller (right paper feed roller 83), and the second elevation mechanism (right tray elevation mechanism 82), the separation plate 11, the upper sensor unit 9*a*, the lower sensor unit 9*b*, the light blocking plate 90, and the controller (engine controller 6) to which the outputs of the upper sensor unit 9*a* and the lower sensor unit 9*b* are input. In the tray parallel elevation mode, when both outputs of the upper sensor unit 9*a* and the lower sensor unit 9*b* are the light blocking output value, the controller (engine controller 6) rotates both the first elevation motor and the second elevation motor so as to move up both the first tray and the second tray. When the output of the upper sensor unit 9*a* is the light blocking output value while the output of the lower sensor unit 9*b* is the transparent output value, the second elevation motor is stopped while the first elevation motor is rotated so that only the first tray is moved up. When the output of the upper sensor unit 9*a* is the transparent output value while the output of the lower sensor unit 9*b* is the light blocking output value, the first elevation motor is stopped while the second elevation motor is rotated so that only the second tray is moved up.

When both outputs of the upper sensor unit 9*a* and the lower sensor unit 9*b* are the light blocking output value (when the both trays are at the same height), both the first elevation motor (left elevation motor 74) and the second elevation motor (right elevation motor 84) rotate. Accordingly, the both trays can be quickly moved up. In addition, when the upper edge of the light blocking plate 90 is lower than the upper sensor unit 9*a*, and the elevation of the second tray (right tray 81) to which the light blocking plate 90 is attached is delayed from that of the first tray (left tray 71), the output value of the upper sensor unit 9*a* becomes the transparent output value while the output value of the lower sensor unit 9*b* becomes the light blocking output value. In this case, only the second tray is moved up. In addition, when the lower edge of the light blocking plate 90 is upper than the lower sensor unit 9*b*, and the elevation of the first tray (left tray 81) is delayed from that of the second tray, the output value of the upper sensor unit 9*a* becomes the light blocking output value while the output value of the lower sensor unit 9*b* becomes the transparent output value. In this case, only the first tray is moved up. Accordingly, the height difference between the trays is not increased.

Accordingly, the height difference between the both trays (the left tray 71 and the right tray 81) is not increased, and hence the both trays can be quickly moved up in parallel while maintaining the height difference between the both trays within the range without a problem (without a collapse of the stack of paper sheets or a paper feed error after the elevation). Accordingly, large size paper sheets (larger than each of the trays) that cannot be set in the conventional apparatus can be set and fed by the multi-tray housing paper feeding device. Further, it is possible to provide the multi-tray housing paper feeding device that can be easily used without a problem even if a large size paper sheets are set. Further, even if inexpensive motors such as brush motors are used, the both trays can be quickly moved up without causing a collapse of the stack of paper sheets placed to stride over the trays. Accordingly, it is possible to provide the paper feeding device 1 that is easily used, and manufacturing cost thereof is reduced.

In addition, a limit value of the height difference between the trays in the tray parallel elevation mode is determined in advance, the length 90L of the light blocking plate 90 in the up and down direction is larger than the inter-optical axis distance between the level of the optical axis 95*a* of the optical sensor of the upper sensor unit 9*a* and the level of the optical axis 95*b* of the optical sensor of the lower sensor unit 9*b*, and is equal to or shorter than the length obtained by adding the inter-optical axis distance to a value of the limit value or smaller.

In this way, the length 90L of the light blocking plate 90 in the up and down direction is set to a length such that the height difference between the both trays becomes the limit value or smaller in the tray parallel elevation mode. Accordingly, a collapse of the stack of paper sheets in the elevation or a paper feed error after the elevation is completed can hardly occur.

In addition, the light blocking plate 90 is attached so that when the both trays are at the same height, the center between the level of the optical axis 95*a* of the optical sensor of the upper sensor unit 9*a* and the level of the optical axis 95*b* of the optical sensor of the lower sensor unit 9*b* coincide with the center of the light blocking plate 90 in the up and down direction. In this way, the light blocking plate 90 is attached so that when the both trays are at the same height, the center position between the both trays coincides with the center position of the light blocking plate 90 in the up and down direction. In this way, when the elevation is completed, the height difference between the trays can be close to zero. Accordingly, heights of both trays can be more apt to coincide with each other.

(Variation 3)

In Variation 2 described above, there is described an example in which the upper sensor unit 9*a* and the lower sensor unit 9*b* are disposed in the left tray 71 while the light blocking plate 90 is disposed in the right tray 81. However, it is possible to dispose the light blocking plate 90 in the left tray 71 and to dispose the upper sensor unit 9*a* and the lower sensor unit 9*b* in the right tray 81.

In this case, the left tray 71 to which the light blocking plate 90 is attached is the second tray, and the left elevation motor 74 for moving up the left tray 71 is the second elevation motor. In addition, the right tray 81 to which the upper sensor unit 9*a* and the lower sensor unit 9*b* are attached is the first tray, and the right elevation motor 84 for moving up the right tray 81 is the first elevation motor. When the both outputs of the upper sensor unit 9*a* and the lower sensor unit 9*b* are the light blocking output value, the engine controller 6 rotates both the right elevation motor 84 and the left elevation motor 74 so as to move up the both trays. In addition, when the output of the upper sensor unit 9*a* is the light blocking output value while the output of the lower sensor unit 9*b* is the transparent output value, the engine controller 6 stops the left elevation motor 74 (second elevation motor) and rotates the right elevation motor 84 (first elevation motor) so as to move up only the first tray (right tray 81). In addition, when the output of the upper sensor unit 9*a* is the transparent output value while the output of the lower sensor unit 9*b* is the light blocking output value, the engine controller 6 stops the right elevation motor 84 (first elevation motor) and rotates the right elevation motor 84 (second elevation motor) so as to move up only the second tray (left tray 71).

For this reason, in Variation 2, there is a relationship of "left"="first" and "right"="second". In Variation 3, there is a relationship of "right"="first" and "left"="second", and then all the above description can be applied.

(Variation 4)

In the embodiment described above, there is described the type of the paper feeding device 1 in which the paper sheets are conveyed from the tray to the right. However, the present disclosure can be applied to a type of the paper feeding device 1 in which the paper sheets are conveyed from the tray to the left. In this case, the left tray 71 in the above description corresponds to the right side tray (first tray) in the type of the paper feeding device 1 in which the paper sheets are conveyed to the left. In addition, the right tray 81 in the above description corresponds to the left side tray (second tray) in the type of the paper feeding device 1 in which the paper sheets are conveyed to the left.

The embodiment described above is merely an example in all aspects and should not be interpreted as a limitation. The scope of the present disclosure is defined not by the above description of the embodiment by the claims, which includes all variations within the meaning and the range equivalent to the claims.

What is claimed is:

1. A paper feeding device comprising:

a first paper feeding portion including a first tray on which paper sheets are placed, a first paper feed roller for sending out the paper sheets placed on the first tray, and a first elevation mechanism for allowing the first tray to move up by a power from a first elevation motor so that the paper sheet placed on the first tray contacts with the first paper feed roller;

a second paper feeding portion including a second tray on which paper sheets are placed, a second paper feed roller for sending out the paper sheets placed on the second tray, and a second elevation mechanism for allowing the second tray to move up by a power from a second elevation motor so that the paper sheet on the second tray contacts with the second paper feed roller, the second paper feeding portion being disposed side by side with the first paper feeding portion in a horizontal direction;

a separation plate disposed to stand between the first tray and the second tray;

a sensor unit attached to the first tray so as to sense a position of the second tray; and a controller configured to receive an output of the sensor unit and to control ON/OFF of the first elevation motor and ON/OFF of the second elevation motor, and control raising of both the first and second trays in a tray parallel elevation mode in which the separation plate is removed, paper sheets having a larger size than each of sheet placing surfaces of the first tray and the second tray are set to stride over both the first tray and the second tray, and the both trays are moved up;

wherein the controller moves up both the first tray and the second tray in the tray parallel elevation mode, by alternately repeating a second tray elevation operation in which the first elevation motor is stopped while the second elevation motor is driven so that the second tray is moved up and a first tray elevation operation in which the second elevation motor is stopped while the first elevation motor is driven so that the first tray is moved up, in such a manner that a height difference between the first tray and the second tray is within a predetermined permissible range on the basis of an output of the sensor unit, the sensor unit is a transparent type optical sensor including a light emitter and a light receiver, a light blocking plate is attached to the second tray so as to pass between the light emitter and the light receiver when the second tray is moved up and down, the light blocking plate is attached in such a manner that a lower edge of the light blocking plate coincides with an optical axis of the light emitter and the light receiver when heights of the first tray and the second tray become equal to each other, when heights of the first tray and the second tray become equal to each other, an output of the sensor unit changes from a transparent output value indicating a transparent state to a light blocking output value indicating a light blocking state by the light blocking plate, and in the tray parallel elevation mode, the controller stops the first elevation motor and rotates the second elevation motor for a predetermined period of time to move up the second tray, so that the output of the sensor unit changes from the light blocking output value to the transparent output value, as the second tray elevation operation, and after the rotation of the second elevation motor for the predetermined period of time, stops the second elevation motor and rotates the first elevation motor until the output of the sensor unit changes from the light blocking output value to the light blocking output value so as to move up the first tray, as the first tray elevation operation.

2. The paper feeding device according to claim 1 wherein an operation panel including a display unit is provided, and when the tray parallel elevation mode is started, the controller checks whether or not an output value of the sensor unit is the light blocking output value, and controls the display unit to display a message for inspection because heights of the both trays are currently different from each other when the output value of the sensor unit is the transparent output value.

3. The paper feeding device according to claim 1, wherein the second paper feed roller is disposed at a position at which a paper sheet conveying distance to a print position is shorter than that of the first paper feed roller, the paper feeding device includes a first upper limit sensor for detecting that the first tray reaches a paper feed position when a top sheet of the paper sheets placed on the first tray contacts with the first paper feed roller, and a second upper limit sensor disposed lower than the first upper limit sensor so as to detect that the second tray reaches a paper feed position when a top sheet of the paper sheets placed on the second tray contacts with the second paper feed roller, and in the tray parallel elevation mode, the controller moves up the first tray and the second tray until the paper feed position of the second tray on the basis of the second upper limit sensor, and rotates the second paper feed roller to feed the paper sheet placed to stride over the first tray and the second tray.

4. The paper feeding device according to claim 1, wherein when a predetermined condition for lowering is satisfied, the first elevation mechanism moves down the first tray by gravity to a reference position when the first tray is drawn out, and the second elevation mechanism moves down the second tray by gravity to the same position as the first tray when the second tray is drawn out.

5. An image forming apparatus comprising the paper feeding device according to claim 1.

6. A paper feeding device comprising:

a first paper feeding portion including a first tray on which paper sheets are placed, a first paper feed roller for sending out the paper sheets placed on the first tray, and a first elevation mechanism for allowing the first tray to move up by power from a first elevation motor so that the paper sheet placed on the first tray contacts with the first paper feed roller;

a second paper feeding portion including a second tray on which paper sheets are placed, a second paper feed roller for sending out the paper sheets placed on the second tray, and a second elevation mechanism for allowing the second tray to move up by a power from a second elevation motor so that the paper sheet on the second tray contacts with the second paper feed roller. the second paper feeding portion being disposed side by side with the first paper feeding portion in a horizontal direction;

a separation plate disposed to stand between the first tray and the second tray;

a sensor unit attached to the first tray so as to sense a position of the second tray; and a controller configured to receive an output of the sensor unit and to control ON/OFF of the first elevation motor and ON/OFF of the second elevation motor, and control raising of both the first and second trays in a tray parallel elevation mode in which the separation plate is removed, paper sheets having a larger size than each of sheet placing surfaces of the first tray and the second tray are set to stride over both the first tray and the second tray, and the both trays are moved up;

wherein the controller moves up both the first tray and the second tray in the tray parallel elevation mode, by alternately repeating a second tray elevation operation in which the first elevation motor is stopped while the second elevation motor is driven so that the second tray is moved up and a first tray elevation operation in which the second elevation motor is stopped while the first elevation motor is driven so that the first tray is moved up, in such a manner that a height difference between the first tray and the second tray is within a predetermined permissible range on the basis of an output of the sensor unit, the sensor unit is a transparent type optical sensor including a light emitter and a light receiver, a light blocking plate is attached to the second tray so as to pass between the light emitter and the light receiver when the second tray is moved up and down, the light blocking plate is attached in such a manner that an upper edge of the light blocking plate coincides with an optical axis of the light emitter and the light receiver when heights of the first tray and the second tray become equal to each other, when heights of the first tray and the second tray become equal to each other, an output of the sensor unit changes from a transparent output value indicating a transparent state to a light blocking output value indicating a light blocking state by the light blocking plate, and in the tray parallel elevation mode, the controller stops the second elevation motor and rotates the first elevation motor for a predetermined period of time to move up the first tray so that the output of the sensor unit changes from the light blocking output value to the transparent output value, as the first tray elevation operation, and after the rotation of the first elevation motor for the predetermined period of time, stops the first elevation motor and rotates the second elevation motor until the output of the sensor unit changes from the transparent output value to the light blocking output value so as to move up the second tray, as the second tray elevation operation.

7. The paper feeding device according to claim 6, wherein an operation panel including a display unit is provided, and when the tray parallel elevation mode is started, the controller checks whether or not an output value of the sensor unit is the light blocking output value, and controls the display unit to display a message for inspection because heights of the both trays are currently different from each other when the output value of the sensor unit is the transparent output value.

8. An image forming apparatus comprising the paper feeding device according to claim 6.

* * * * *